US010916097B2

(12) United States Patent
Wodarz

(10) Patent No.: US 10,916,097 B2
(45) Date of Patent: Feb. 9, 2021

(54) SYSTEMS, APPARATUSES AND METHODS FOR MODIFYING AWARD PAYOUTS THROUGH FLUCTUATING ADJUSTMENTS

(71) Applicant: KING SHOW GAMES, INC., Minnetonka, MN (US)

(72) Inventor: Nathan Wodarz, Apple Valley, MN (US)

( * ) Notice: Subject to any disclaimer, the term of this patent is extended or adjusted under 35 U.S.C. 154(b) by 78 days.

(21) Appl. No.: 16/417,965

(22) Filed: May 21, 2019

(65) Prior Publication Data

US 2019/0362599 A1 Nov. 28, 2019

Related U.S. Application Data

(60) Provisional application No. 62/674,781, filed on May 22, 2018.

(51) Int. Cl.
*G07F 17/32* (2006.01)

(52) U.S. Cl.
CPC ..... *G07F 17/3262* (2013.01); *G07F 17/3211* (2013.01); *G07F 17/3244* (2013.01)

(58) Field of Classification Search
CPC ..... G07F 17/3262; G07F 17/3211; G07F 17/3244
See application file for complete search history.

(56) References Cited

U.S. PATENT DOCUMENTS 6,527,270 B2 * 3/2003 Maksymec ..... G06Q 50/34 273/138.1
6,632,140 B2 10/2003 Berman et al.
7,316,609 B2 1/2008 Dunn et al.
7,381,134 B2 6/2008 Cuddy et al.
7,494,413 B2 2/2009 Singer et al.
7,601,062 B2 10/2009 Cole et al.
8,021,222 B2 9/2011 Walker et al.
8,282,466 B2 * 10/2012 Hornik ..... G07F 17/32 463/25
2002/0153656 A1 * 10/2002 Maksymec ..... G07F 17/3288 273/138.1
2004/0053679 A1 3/2004 Getz et al.
2004/0082378 A1 4/2004 Peterson et al.
2004/0162134 A1 8/2004 Walker et al.
(Continued)

*Primary Examiner* — Omkar A Deodhar
*Assistant Examiner* — Matthew D Hoel

(57) ABSTRACT

Systems and methods for facilitating variation and adjustment of payouts during participation of a gaming feature. From the player's perspective, gaming payout enhancements may involve fluctuating beneficial and non-beneficial adjustments. One embodiment involves providing an initial award modifier, and a plurality of selectable items. Some of the selectable items have a positive or negative modifier adjustment value associated therewith, and at least one of the selectable items includes an awarded value that also terminates further modifier adjustment. The player selects the selectable items, and an accumulated modifier is adjusted based on the positive or negative modifier adjustment values associated with the selected items. Adjustment of the accumulated modifier value is discontinued in response to player selection of the awarded value and the termination of modifier adjustment. The accumulated modifier at the time of termination of modifier adjustment is applied to the awarded value to provide a modified awarded value.

20 Claims, 13 Drawing Sheets

(56) References Cited

U.S. PATENT DOCUMENTS

| | | | | |
|---|---|---|---|---|
| 2004/0171419 | A1 | 9/2004 | Walker et al. | |
| 2005/0059455 | A1* | 3/2005 | Gerrard | G07F 17/32 463/16 |
| 2006/0068872 | A1 | 3/2006 | Walker et al. | |
| 2006/0148548 | A1* | 7/2006 | Hornik | G07F 17/32 463/16 |
| 2009/0325688 | A1* | 12/2009 | Naicker | G07F 17/3244 463/27 |
| 2011/0034233 | A1 | 2/2011 | Berman et al. | |
| 2013/0296010 | A1 | 11/2013 | Berman | |
| 2013/0296011 | A1 | 11/2013 | Berman et al. | |
| 2014/0080579 | A1* | 3/2014 | Abouchar | G07F 17/3255 463/25 |

* cited by examiner

SYSTEMS, APPARATUSES AND METHODS FOR MODIFYING AWARD PAYOUTS THROUGH FLUCTUATING ADJUSTMENTS

FIELD

This disclosure relates generally to games, and more particularly to systems, apparatuses and methods for adjusting at least one payout constituent to enable variation and adjustment of an expected payout during participation of the gaming feature.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to facilitate gaming payout enhancements that, from the player's perspective, involve fluctuating beneficial and non-beneficial adjustments.

In accordance with one embodiment, a slot game device provides a gaming award with variable factors being favorably or unfavorably adjustable during player participation that results in the gaming award. The slot game device includes a display presenting a plurality of symbol locations forming an array, a user interface including at least one user input to enable a player to select the symbol locations presented via the array, a wager input device structured to identify and validate player assets and to permit the player to play the slot game event when the player assets are provided, and a processor. A processor-executable modifier assignment program module configures the processor to assign both positive and negative award modifier adjustment values to concealed player-selectable items, to facilitate repeated player selection of different ones of the concealed player-selectable items to reveal their respective award modifier adjustment values, and to maintain a running total of a current award modifier as prescribed by the player-selected award modifier adjustment values. A processor-executable credit value assignment program module configures the processor to assign at least one credit value to the concealed player-selectable items, to facilitate player selection of at least one of the concealed player-selectable items to reveal its selected credit value, and to terminate further player selection of the concealed player-selectable items in response to player selection of the at least one of the concealed player-selectable items revealing the selected credit value. A processor-executable gaming award calculation program module configures the processor to calculate the gaming award based on the selected credit value as modified by the running total of the current award modifier at the time of the player selection of the selected credit value.

In more particular embodiments, the slot game device further includes a processor-executable initial modifier assignment program module configuring the processor to facilitate identification of an initial modifier to initially set the current award modifier. In a still more particular embodiment, the processor-executable initial modifier assignment program module configures the processor to facilitate identification of an initial modifier by presenting a plurality of concealed initial modifiers, and facilitating player selection of at least one of the concealed initial modifiers to reveal the respective initial modifier and to set the current award modifier to the respective initial modifier.

In another particular embodiment of such a slot game device, the processor-executable modifier assignment program module further configures the processor to assign a zero award modifier adjustment value to the concealed player-selectable items, and to cause the current award modifier to remain unchanged in response to the player selecting the zero award modifier adjustment value from the concealed player-selectable items.

In another embodiment of such a slot game, the positive and negative award modifier adjustment values respectively includes positive and negative award multiplier adjustment values. In this embodiment, the running total of the current award modifier involves a running total of a current award multiplier. The processor-executable gaming award calculation program module may configure the processor to calculate the gaming award based on the selected credit value multiplied by the running total of the current award multiplier at the time of the player selection of the selected credit value.

In still another embodiment, the processor is configured to initiate a bonus event in response to a trigger feature, and in response thereto, to enable the slot game device to provide the gaming award with one or more variable factors being favorably or unfavorably adjustable during player participation that results in the gaming award.

In another embodiment, the processor-executable modifier assignment program module configures the processor to maintain a running total of a current award modifier by adding positive modifier adjustment values to the running total of the current award modifier, and subtracting negative modifier adjustment values from the running total of the current award modifier.

In still another embodiment of such a slot game device, the processor-executable credit value assignment program module configures the processor to assign multiple credit values to the concealed player-selectable items, and, to facilitate player selection of multiple concealed player-selectable items to reveal their respective selected credit values. The processor-executable credit value-assignment program module terminates further player selection of the concealed player-selectable items in response to player selection of a number of the concealed player-selectable items revealing respective selected credit values. In such an embodiment, the processor-executable gaming award calculation program module configures the processor to calculate the gaming award based on the total of the multiple selected credit values, as modified by the running total of the current award modifier at the time of the player selection of a final one of the selected credit values.

In another embodiment, a slot game device is provided for enhancing gaming awards in slot games. The slot game device includes a display presenting a plurality of grid locations forming an array, a user interface including at least one user input to enable a player to select the grid locations presented via the array, a wager input device structured to identify and validate player assets and to permit the player to play the slot game event when the player assets are provided, and a processor. The processor is configured to provide an initial award multiplier. The processor is further configured to provide a plurality of selectable items, one or more of the selectable items having either a positive or negative multiplier adjustment value associated therewith, and one or more of the selectable items having at least a credit award that serves as a termination of multiplier adjustment in addition to a grant of the credit award. The processor is configured to facilitate user selection of the selectable items, adjust an accumulated multiplier based on the positive or negative multiplier adjustment values associated with the selected ones of the selectable items, discontinue adjustment of the accumulated multiplier value in response to player selection of the credit award and the termination of multiplier adjustment, and multiply the accumulated multiplier at the time of termination of multiplier adjustment to the credit award to provide an enhanced gaming award.

In a more particular embodiment of such a slot game device, the processor is configured to provide the initial award multiplier by presenting a plurality of selectable initial items concealing initial award multipliers to the player, and to set the accumulated multiplier to the initial award multiplier associated with the selectable initial item selected by the player. In another embodiment, the processor is configured to adjust the accumulated multiplier by adding the selected positive multiplier adjustment values to the accumulated multiplier value, and by subtracting the selected negative multiplier adjustment values from the accumulated multiplier value.

In one embodiment of such a slot game device, the processor is configured to cause the display to present each of the plurality of selectable items in respective ones of the grid locations of the array. In another embodiment, the processor is configured to recognize triggering of a bonus event, and in response thereto, to enable the slot game device to suspend activity in a primary gaming event and provide the enhanced gaming award via the bonus event. In yet another embodiment, the processor is configured to adjust the accumulated multiplier by increasing or decreasing the accumulated multiplier based on the positive or negative multiplier adjustment values selected via the selectable items.

In accordance with another embodiment, an apparatus is provided for enhancing gaming awards in gaming activities. The apparatus includes means for establishing an initial award multiplier and presenting the initial award multiplier via a display, and for causing the initial award multiplier to be stored as a current award multiplier in data storage. At least one display is provided for presenting a plurality of player-selectable items via the display. The apparatus further includes means for associating multiplier adjustment values to respective ones of the player-selectable items, where at least one of the multiplier adjustment values is a positive value and at least one of the multiplier adjustment values is a negative value, and means for concealing the multiplier adjustment value until its respective one of the player-selectable items is selected. The apparatus of this embodiment includes means for adjusting the current award multiplier by each selected one of the multiplier adjustment values. The representative apparatus includes means for allowing further selections of the player-selectable items until a termination event occurs, and for disallowing further selections of the player-selectable items when the termination event occurs. The apparatus includes means for multiplying a gaming award and the current multiplier value at the time the termination event occurs to create an enhanced gaming award.

In another embodiment, a method is provided for enhancing gaming awards in gaming activities. The method includes establishing an initial award multiplier and presenting the initial award multiplier via a display, and causing the initial award multiplier to be stored as a current award multiplier in data storage. Multiple player-selectable items are presented via the display. Multiplier adjustment values are associated with respective player-selectable items, where at least one of the multiplier adjustment values is a positive value and at least one of the multiplier adjustment values is a negative value. In this embodiment, the multiplier adjustment value is concealed from the player's perception until its respective one of the player-selectable items is selected. The current award multiplier is adjusted by each selected one of the multiplier adjustment values. Further selections of the player-selectable items are allowed until a termination event occurs, at which time further selections of the player-selectable items are no longer allowed. A gaming award is multiplied by the current multiplier value at the time the termination event occurs to create an enhanced gaming award.

In a more particular embodiment, the method involves associating one or more credit values to respective ones of the player-selectable items, and establishing the gaming award as a selected one of the player-selectable items having the credit value. A still more particular embodiment further involves establishing the player selection of one of the player-selectable items having the credit value as the termination event. In another embodiment, the player-selectable item having the credit value also includes one of the multiplier adjustment values.

In another particular embodiment, the method further involves displaying a number of second player-selectable items each having a respective concealed initial award modifier associated therewith, where establishing an initial award multiplier involves assigning a player-selected one of the initial award multipliers as the initial award multiplier.

In another embodiment, a method is provided for modifying gaming awards in gaming activities. In this embodiment, the method involves providing an initial award modifier, and providing a plurality of selectable items. One or more of the selectable items have either a positive or negative modifier adjustment value associated therewith, and one or more of the selectable items have at least an awarded value that serves as a termination of modifier adjustment in addition to a grant of the awarded value. The method involves facilitating user selection of the selectable items, adjusting an accumulated modifier based on the positive or negative modifier adjustment values associated with the selected ones of the selectable items, discontinuing adjustment of the accumulated modifier value in response to player selection of the awarded value and the termination of modifier adjustment, and applying the accumulated modifier at the time of termination of modifier adjustment to the awarded value to provide a modified awarded value.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
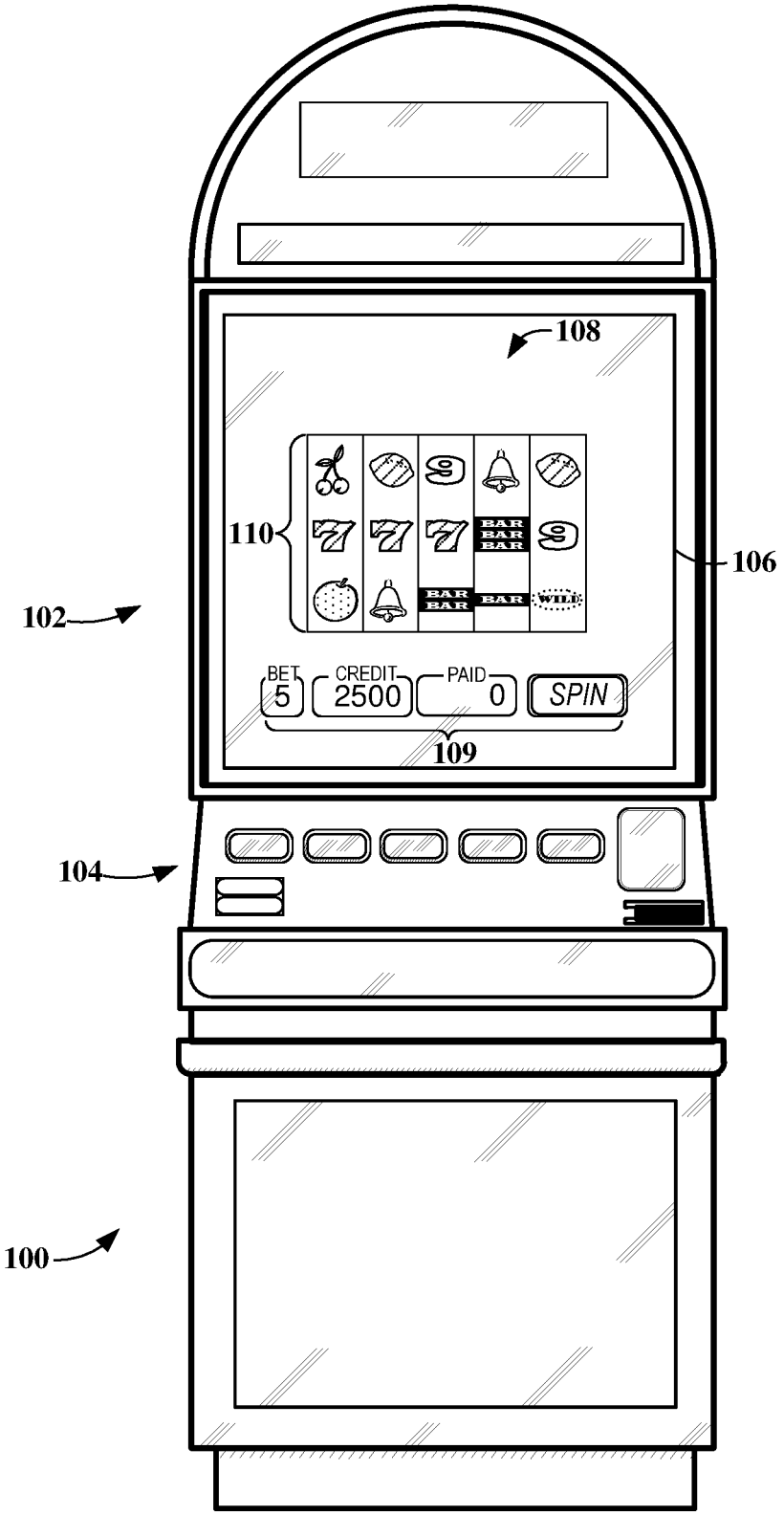
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for adjusting at least one payout constituent to enable variation and adjustment of an expected payout during participation of the gaming feature. The payout constituent may be an award modifier, i.e. a value, mathematical function, formula, or other that is capable of modifying a payout amount, such as a multiplier. The payout constituent may alternatively or additionally be an award amount itself, which is adjusted during participation in the feature. In the context of adjusting payout modifiers, embodiments described herein provide game play that involves a manner of applying award modifiers to awards, or otherwise enhancing an eventual award that is adjustable and/or indeterminate during participation in an award-amount-determination stage of a gaming event, at least by enabling changes to an award modifier(s) during play of a game(s) that is ultimately used to modify an intermediate award to arrive at the eventual award for that gaming event. These and other embodiments are described in greater detail below, to facilitate an understanding of the principles disclosed herein.

The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves a manner of applying award modifiers to awards, or otherwise enhancing an eventual award that is adjustable and/or indeterminate during participation in an award-amount-determination stage of a gaming event, at least by enabling changes to an award modifier(s) during play of a game(s) that is ultimately used to modify an intermediate award to arrive at the eventual award for that gaming event. The gaming event may be any portion, segment, sub-game (or entire game) of a gaming activity, such as, for example, where the gaming activity is a slot game, and the gaming event is one or more "spins" or other randomizations of slot game symbols in a primary game play, bonus game play, free play (e.g., free spins), and/or other primary or auxiliary portion of a slot game. The principles herein may be applied to bonus events in any gaming activity, whether slot games, card games (e.g., video poker), bingo, keno, roulette, craps, etc., or as a gaming activity in and of itself.

In one representative embodiment, the gaming activity is a slot game, and the gaming event is a bonus event that is triggered by some activity during play of a primary slot game or any other stage of the slot game. In one embodiment, the "modifier" is represented by a multiplier value, which can be used to enhance an awarded credit value(s) by increasing that awarded credit value by the multiplier value. In such an embodiment, a multiplier is initially selected (blindly/randomly, or alternatively with knowledge of the multiplier value) by the player, or may alternatively/additionally be provided by the gaming system or elsewhere (e.g., a casino bonus or perk) as part of the game, or any other manner of providing an initial multiplier(s). In one embodiment, the player may then select from a plurality of concealed selectable items, some of which have upward or downward multiplier adjustment value (e.g., +1×, +8×, −3×, etc.), or alternatively the next multiplier adjustment value may be provided to the player in some manner. The selected/provided multiplier adjustment value is applied to a current multiplier adjustment value to update the current multiplier adjustment value in view of the selected/provided multiplier adjustment value. For example, in such an embodiment, if the current multiplier adjustment value was 16× (i.e. a multiplier of 16), and the selected/provided multiplier adjustment value was −3×, the current multiplier adjustment value would be adjusted to 13×, i.e. 16×−3× (or alternatively noted, 16×+(−3×)). This selection (or providing) of multiplier adjustment values continues until some predetermined event(s), or random event(s) in other instances, or some combination of predetermine/random event(s), occurs. For example, the multiplier adjustment value adjustment may continue until a special symbol/item is selected (or provided) such as a stop symbol, or may continue until a credit value (or some number of credit values) is selected/provided to which the running count of the multiplier adjustment value is applied, or a fixed number of selected/provided multiplier adjustment values, or a random number of selected/provided multiplier adjustment values, or a fixed or random selection/provision time, or any other desired criteria for ending the multiplier adjustment value episode to ultimately arrive at a multiplier adjustment value(s) to use to enhance a credit value(s) to arrive at the award for that game segment. For example, in one embodiment, the player continues to select multiplier adjustment values (which impact a current adjustment value) until selecting a credit value, at which time the current adjustment value is applied to the selected credit value (e.g., the current state of the multiplier adjustment value is applied to the selected credit value) to arrive at the final award for that game play segment (e.g., for that slot game bonus event, etc.).

In another embodiment, multiple credit values may be allowed to be selected, which may be positive or negative credit values that impact a running credit value in a similar fashion to how the modifier adjustment value is updated and maintained. Some triggering event(s) or termination event(s) could determine when both the multiplier adjustment value and credit value settle on respective final values, when the final multiplier is then applied to the final credit value to arrive at a product that identifies the final award for that game play segment. In other embodiments, selection of (or system provision of) multiple credit values may positively add to one another to provide a final credit value that can be enhanced by the final modifier value. In still other representative embodiments, multiple credit values can be selected (or provided) where the last/most recent credit value (or other designation, such as the highest credit value, average credit value, etc.) selected/provided serves as the credit value enhanced by the settled-upon multiplier value. These and other variations may be implemented within the scope and spirit of the disclosure.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
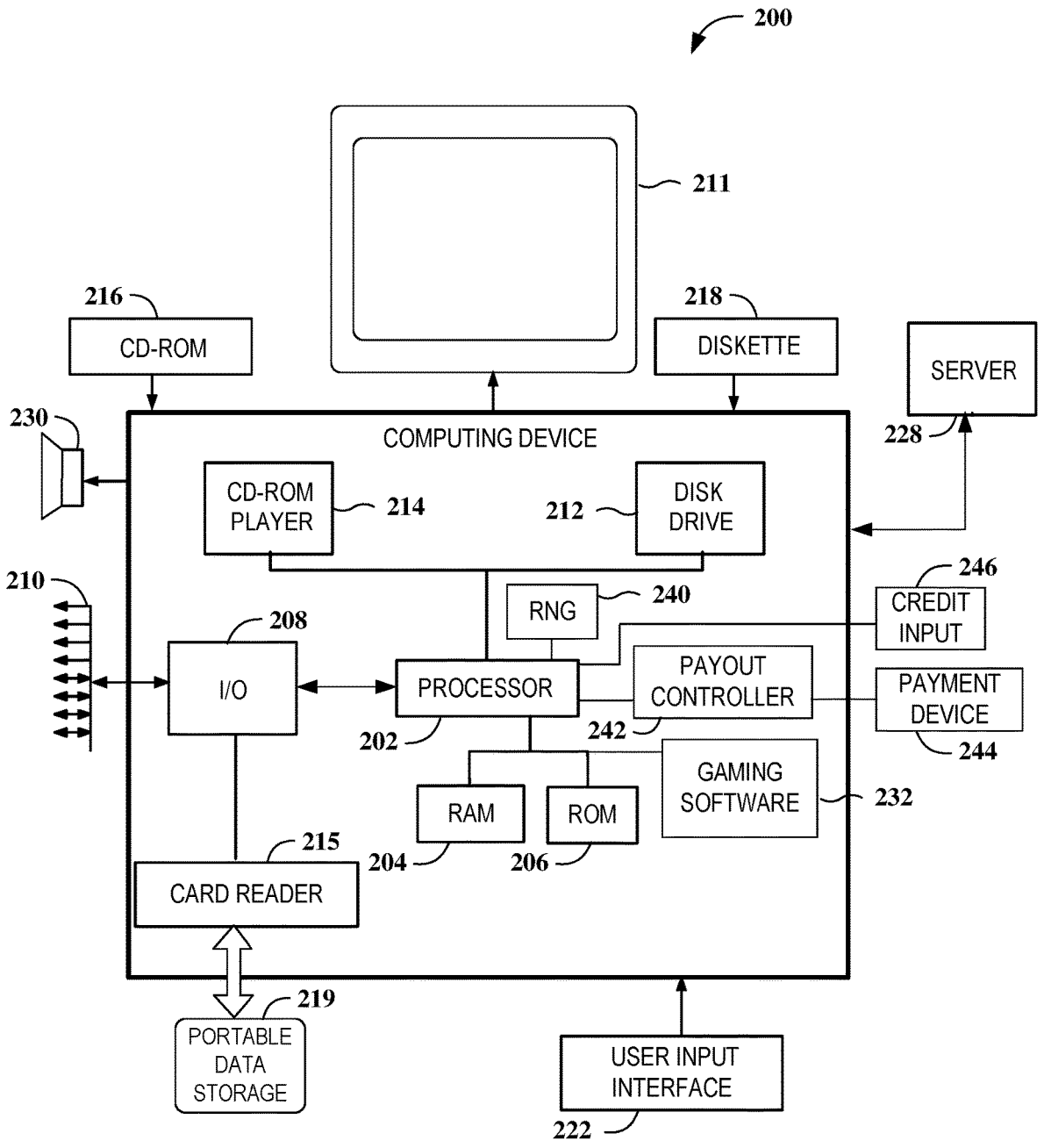
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

As used herein, data "storage" includes any temporary or persistent means for storing electronic data, including hard magnetic or solid state drives, memory devices, removable storage or memory devices, and/or any other technology capable of preserving data for the storage time desired.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, an award modifier is made available to a player, such as through player selection, or system assignment, or otherwise. The player is allowed to engage in a game segment where that awarded modifier is adjusted upward or downward (including remaining the same) until some modifier adjustment termination event(s) occurs, thereby establishing a final award modifier for that particular game segment. The final award modifier is then applied to an award value(s) (e.g., credit value award(s)), where that award value(s) is enhanced by the final award modifier. For example, the award value may be a credit value (a single value or aggregation of a plurality of values) selected by or provided to the player, and the final award modifier may be a running multiplier value that is adjusted by selected/assigned modifier increments or decrements to ultimately settle on the final award modifier. The final multiplier value is multiplied by the credit value to result in a final payout for that particular game segment.

Some embodiments involve manners of applying award modifiers to awards, such as in bonus events of slot games. A multiplier(s) is initially selected by the player, or otherwise provided, and serves as the initial multiplier(s). One embodiment involves the player selecting from a plurality of concealed selectable items, some of which have upward or downward multiplier adjustment value (e.g., +1×, +8×, −3×, etc.), and at least one of the concealed selectable items has an awarded value (e.g., some number of credits) that also serves as a termination of modifier adjustment in addition to the awarded value. The player may continue selecting the items, and consequently causing an up or down adjustment of the accumulated modifier, where the ability to select ends (and the multiplier stops changing) in response to player selection of the awarded value. The settled multiplier is then applied to the selected credit award to provide the total award. In these and other embodiments, it should also be noted that up/down adjustment may also include a zero adjustment.

These examples are provided for representative purposes, to facilitate an understanding of the present disclosure. These and other examples are provided herein, some with reference to the accompanying drawings, which serve as representative examples of the principles and teachings provided herein that enable those skilled in the art to understand the principles and teachings via these examples and other descriptions set forth herein.

Many embodiments may be described in terms of a slot game, where symbols are matched on paylines to determine payout awards. However, the principles described herein are equally applicable to other games of chance, as described herein and as will be readily apparent to those skilled in the art from the teachings herein.

Figure 3:
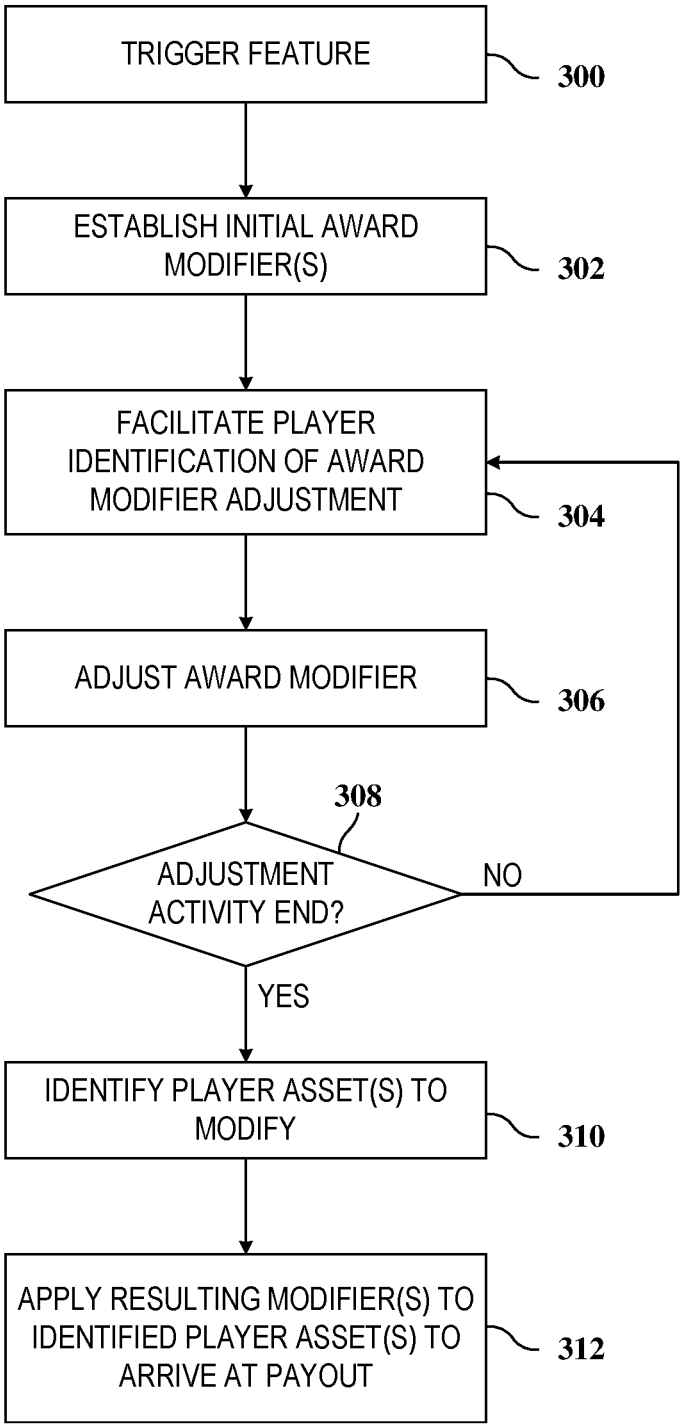
FIG. 3 depicts a flow diagram of a representative manner for enhancing payouts in gaming activities.

FIG. 3 depicts an embodiment of an award determination feature in the context of such a slot game embodiment, although the principles described herein are applicable to any game of chance. Further, the embodiment of FIG. 3 may be described for use in a base/primary slot game and/or as a secondary/auxiliary feature of a base game (e.g., a "bonus" game), but is available in any situation where a gaming award opportunity is to be made to a player.

A feature of the game is triggered 300 to initiate a representative award determination feature as described herein. The trigger 300 may simply be the player's participation in a gaming event of a primary game, such as allocating credits or other player assets in the primary play mechanism of a slot game. The trigger 300 may be a symbol combination, special symbol, randomly-provided event, periodically-provided event, or other trigger to initiate the award determination feature, which may or may not be separate from the primary or other gaming event associated with the game. Any desired trigger feature 300 may be implemented. As described in further detail below, one embodiment involves initiating a bonus event through a trigger feature 300 that involves obtaining a symbol or symbol combination in another part of the game, such as receiving a number of corresponding symbols in a primary slot game.

When the feature has been triggered, the embodiment of FIG. 3 involves establishing 302 an initial award modifier(s). In one embodiment, a single initial/starting award modifier is utilized, although other embodiments may involve two, three, or more initial award modifiers that will be adjusted via the modifier adjustment techniques described herein. For example, two or three different initial award modifiers may be established 302, and each used independently or collectively to ultimately impact the final award modifier. In one embodiment, an initial award modifier is established 302 via the system, such as being awarded a random initial award modifier, which in some embodiments may be positive, negative, or zero. In other embodiments, the initial award modifier may be established 302 as a fixed number, such as zero, or any other fixed number. Initial award modifier values may alternatively be established 302 by some activity occurring in connection with the gaming event, such as the triggering condition causing a bonus event that triggers 300 the feature—e.g., where the quantity, type, characteristics, and/or other factors of symbols or other game elements triggering 300 the feature or otherwise associated with the feature establish 302 or otherwise influence establishing 302 the initial award modifier(s).

In some embodiments, multiple initial award modifiers are provided, but one is established 302 through selection of one of the multiple initial award modifiers. For example, after the feature has been triggered 300, one embodiment involves presenting a plurality (e.g., three) selectable items, at least one of which (and in one embodiment all) includes initial award modifiers that are hidden from the player's view until selected. When the player selects one of the selectable items, the hidden initial award modifier is revealed, thereby establishing 302 the initial award modifier.

In accordance with embodiments of the disclosure, the initial award modifier serves as an initial modifier value that may be used to enhance a payout value/award, where the initial award modifier may be adjusted repeatedly, upwards or downwards (or in some embodiments no/zero adjustment at one or more adjustment opportunities), to ultimately arrive at a settled or final modifier value. In the embodiment of FIG. 3, this is depicted via facilitating 304 player identification of an award modifier adjustment, adjusting 306 the award modifier pursuant to the identification of the award modifier adjustment, and determining 308 whether the adjustment activity has ended, where the award modifier adjustment may continue until the adjustment activity has ended. More particularly, the system may facilitate 304 player identification of an award modifier adjustment, such as, for example, selecting from a plurality of selectable items where one, more, or all of the selectable items are associated with one (possibly two or more in some embodiments) modifier adjustment value. In one embodiment, the selectable items do not reveal the associated modifier adjustment value until selected by the player (or provided by the game/system in other embodiments). When the modifier adjustment value is known, it is applied to the current award modifier value. For example, if the initial award modifier value was established 302 to be 8× (an 8 times multiplier), and the first award modifier adjustment value was identified 304 to be +3×, the current award modifier value would be adjusted 306 to 11×.

If the adjustment activity has not ended 308, the player may continue to identify 304 another award modifier adjustment. A termination event, or any one or more of a plurality of possible termination events, can result in ending 308 of the adjustment activity. For example, in one embodiment, selection/identification 310 of a credit value(s) or other player assets rather than an award modifier adjustment value will end 308 the adjustment activity, and enable the current award modifier adjustment value to be applied to the selected/identified credit value(s). In other embodiments, a credit value(s) may be identified 310 in other manners, and some other indication may indicate end 308 of the adjustment activity, such as, for example, selecting/identifying a special symbol (e.g., stop symbol, null symbol, bonus end symbol, certain color, or any desired characteristic), reaching a fixed number of attempts (e.g., the player was awarded five selections to arrive at an award modifier adjustment value), a random number of attempts, reaching a top limit, reaching a lower limit, etc. The current state of the award modifier adjustment value is then applied 312 to the identified 310 player assets to arrive at a payout/award for the particular bonus game or other gaming event.

Figure 4:
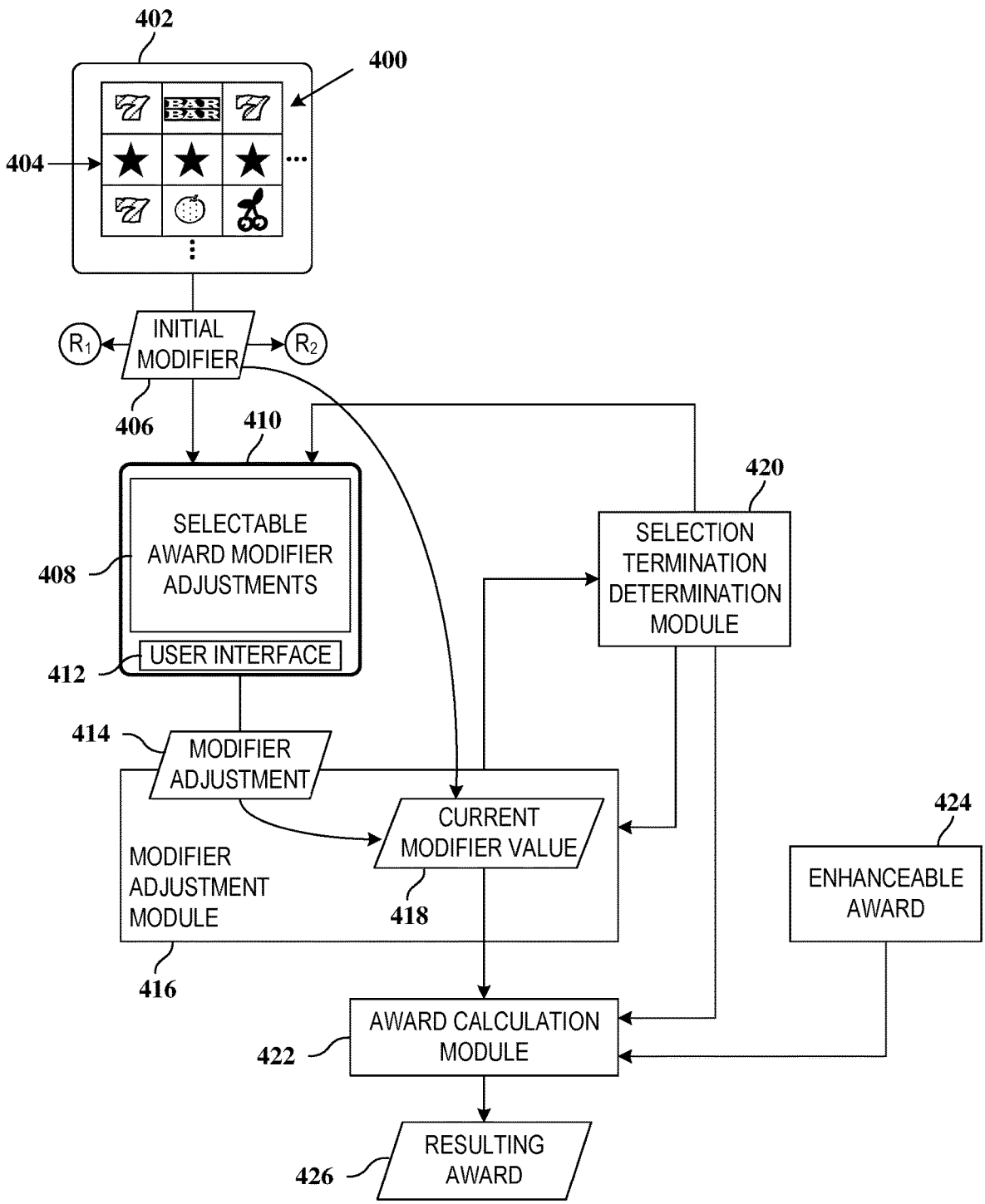
FIG. 4 is a block diagram generally depicting a representative manner in which gaming awards in gaming activities may be enhanced.

FIG. 4 is a block diagram generally depicting a representative manner in which gaming awards may be enhanced in accordance with the disclosure. An award identification feature in accordance with the disclosure is employed to facilitate repeated opportunities to adjust an award modifier that may then be applied to some player asset (e.g., credit award) to create anticipation in the quantity and timing of the ultimate award. The example of FIG. 4 is described in terms of a slot game, although the principles described herein are equally applicable to other games of chance.

In the representative embodiment of FIG. 4, a player participates in a slot game 400, which may be viewed via at least one display 402. The award enhancement feature may be part of the base/primary slot game, or may be part of a secondary gaming event such as a bonus event. In the illustrated embodiment, the award enhancement feature is provided as part of a bonus event that is triggered during participation in a primary slot game 400. For example, a number of matching symbols, such as the three star symbols depicted on line 404, may trigger a bonus event in which the award enhancement feature may be employed.

In the present example, when the feature has been triggered, an initial award modifier 406 may be provided to the player, selected by the player, or otherwise attributed to the player. In one embodiment, the initial modifier 406 is selected by the player, by selecting among a plurality of concealed selectable items which reveal the initial modifier 406 in response to the selection. The initial modifier 406 may be a value within some range depicted by $R_1$-$R_2$. The initial modifier 406 becomes the current modifier value 418, which is managed by the modifier adjustment module.

The current modifier value 418, which may correspond to the initial modifier 406 initially, is adjustable in accordance with the principles described herein. This "adjustable" nature enables the modifier value to change, hopefully in an upward fashion from the player's perspective, until the modifier adjustment period terminates. In the illustrated embodiment, the player is presented with a plurality of selectable award modifier adjustments 408 via a display 410 or other presentation module, from which the player may select by way of a user interface 412. The selected modifier adjustment 414 is received at the modifier adjustment module 416, where the current modifier value 418 is adjusted based on the value of the modifier adjustment 414. For example, assume that the initial modifier 406 was a 6× multiplier (six times multiplier), thereby initially setting the current modifier value 418 to the number "6" (i.e. 6× multiplier). If the player selects a modifier adjustment 414 of +3× from the selectable award modifier adjustments 408, the modifier adjustment module 416 will add three to the existing current modifier value of six, resulting in a new current modifier value 418 of nine (i.e. 6×+3×=9×).

This selection of selectable award modifier adjustments 408 occurs until some time, event, and/or other condition occurs, which is determined by the selection termination determination module 420. For example, the selection termination determination module 420 may (in some embodiments) determine whether a fixed or random number of selections of the selectable award modifier adjustments 408 have been made. In other embodiments, the selection termination determination module 420 may determine that the player has selected something other than an award modifier from the selectable award modifier adjustments 408, such as a credit value or other symbol, indicia, etc. that indicates that no further selections of award modifier adjustments will occur for this particular bonus or gaming event. If the selection termination determination module 420 does not identify a terminating event, the player is again allowed to select among the selectable award modifier adjustments 408 to continue to update/adjust the current modifier value 418 via further modifier adjustments 414.

On the other hand, if the selection termination determination module 420 identifies a terminating event, it triggers the award calculation module 422 to apply the current modifier value 418 to enhanceable award 424. For example, in an embodiment where player selection of a credit value rather than a modifier adjustment 414 terminates further selections of selectable award modifier adjustments 408, the selected credit value may serve as the enhanceable award 424, or alternatively the enhanceable award 424 may be provided by the system, may carry over from a primary game payout, or may be determined in any desired fashion. In any event, the award calculation module 422 applies the current modifier value 418, as adjusted through potentially a plurality of modifier adjustments 414, to the enhanceable award 424 to arrive at a resulting award 426. For example, if the current modifier value 418 ended at an 8× value, and the enhanceable award was 100 credits, the resulting award 426 would be 800 credits (100 credits enhanced by an eight times multiplier).

The enhanceable award 424 may be selectable by the player among various selectable options. Alternatively the enhanceable award 424 may be awarded in a primary game, or may be some mathematical calculation of other values associated with the game. The enhanceable award 424 may be within some award range, may be less than some maximum value, may be greater than some minimum value, may be entirely random, may be fixed, etc. Some embodiments, such as those described in greater detail below, may alternatively or additionally involve adjusting the enhanceable award 424 until a final enhanceable award 424 is settled on for use by the award calculation module 422 in generating the resulting award 426.

Figure 5:
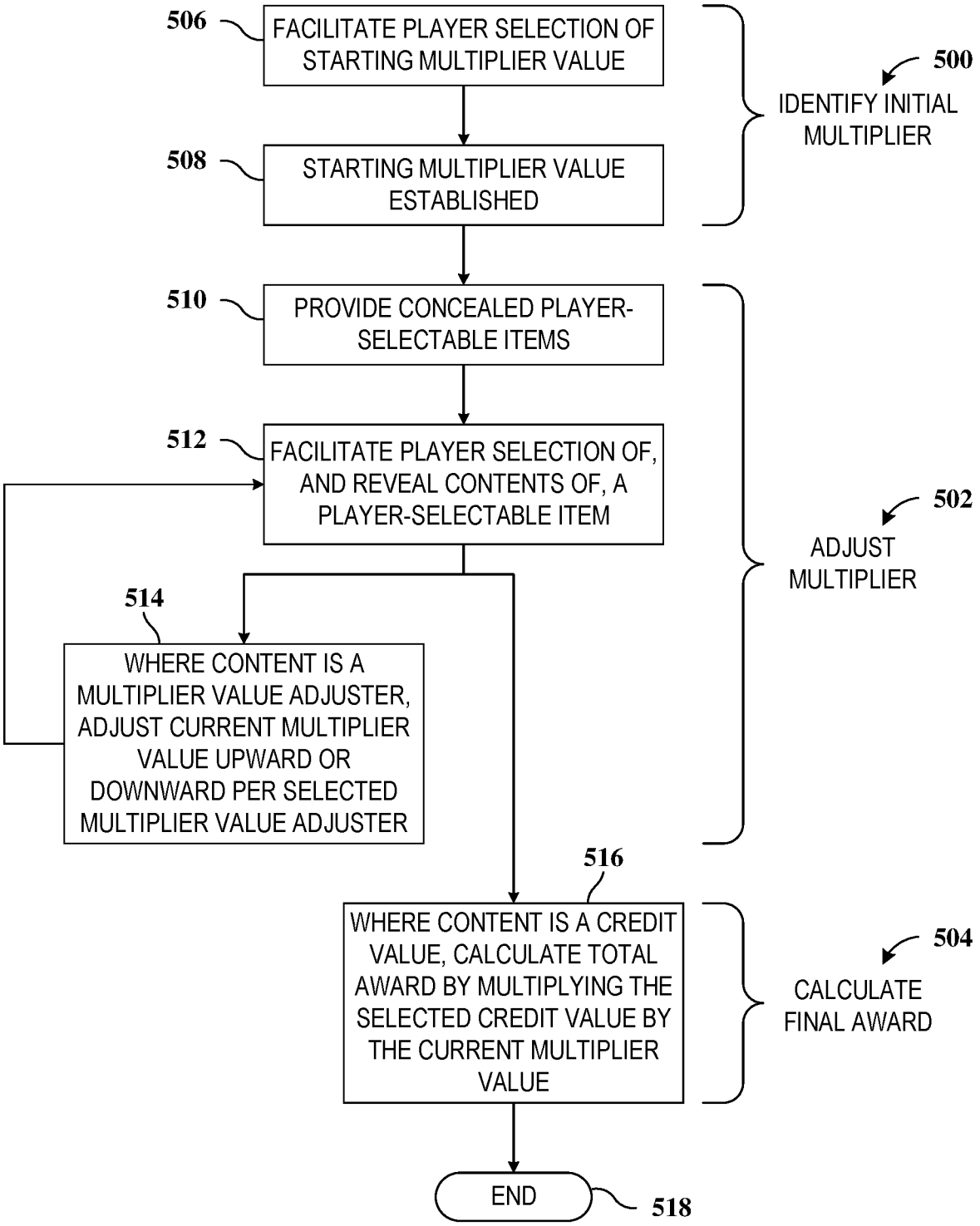
FIG. 5 is a flow diagram illustrating another representative embodiment of a manner in which a gaming machine or other computing environment can enhance gaming awards through repeated selection of award multiplier adjustment values and maintaining a current award multiplier for use in enhancing a payout(s).

FIG. 5 is a flow diagram illustrating another representative embodiment of a manner in which a gaming machine or other computing environment can enhance gaming awards. In this particular embodiment, a first stage involves identifying 500 an initial multiplier, a second stage involves adjusting 502 the multiplier, and another stage involves calculating 504 the final award. Representative actions for identifying 500 and initial multiplier include, for example, facilitating 506 player selection of a starting multiplier value, and establishing 508 the starting multiplier value. For example, facilitating 506 player selection of a starting multiplier value may involve allowing the player to select from a plurality of selectable items of which multiplier values are respectively associated and hidden until selected. Once selected, the starting multiplier value is established 508, and becomes the current multiplier. It should be noted that the starting multiplier value may be provided in any manner, including assigning a random multiplier value, setting the starting multiplier value to a fixed number (e.g., zero, 5×, 8×, etc.), etc.

In this embodiment, a plurality of concealed, player-selectable items are provided. The items may be any physical, electronic, visible, audio, and/or other perceivable items. Associated with one or more, and in some embodiments all, of the player-selectable items are multiplier adjustment values (e.g., +3×, +7×, −4×, 0, etc.). The system facilitates 512 player selection of a player-selectable item, and in response thereto, the contents of the player-selectable item is revealed.

In this representative embodiment, where the selected content is a multiplier value adjuster, the current multiplier value is adjusted 514 upward or downward (or in some embodiments may remain the same) according to the selected multiplier value adjuster. For example, if the selected multiplier value adjuster was −2×, and the current multiplier value was 10×, the new current multiplier value would be 10×−2×=8×. In one embodiment, after such adjustment 514, the system again facilitates 512 player selection of another player-selectable item. This process of adjusting 502 the multiplier can continue until some termination event occurs.

In the present example, the termination event corresponds to the player selecting a credit value rather than a multiplier value adjuster. In other words, one or more of the player-selectable items may be a credit value(s) or other award that can be enhanced or otherwise adjusted by the current multiplier value. For example, where selected content is a credit value, the total award is calculated 516 by multiplying the selected credit value by the current multiplier value, which corresponds to calculation 504 of the final award. In this embodiment, once that occurs, no further player-selectable items are selected, and rather a final award is calculated 504, awarded to the player, and the bonus or other gaming event ends 518.

Figure 6:
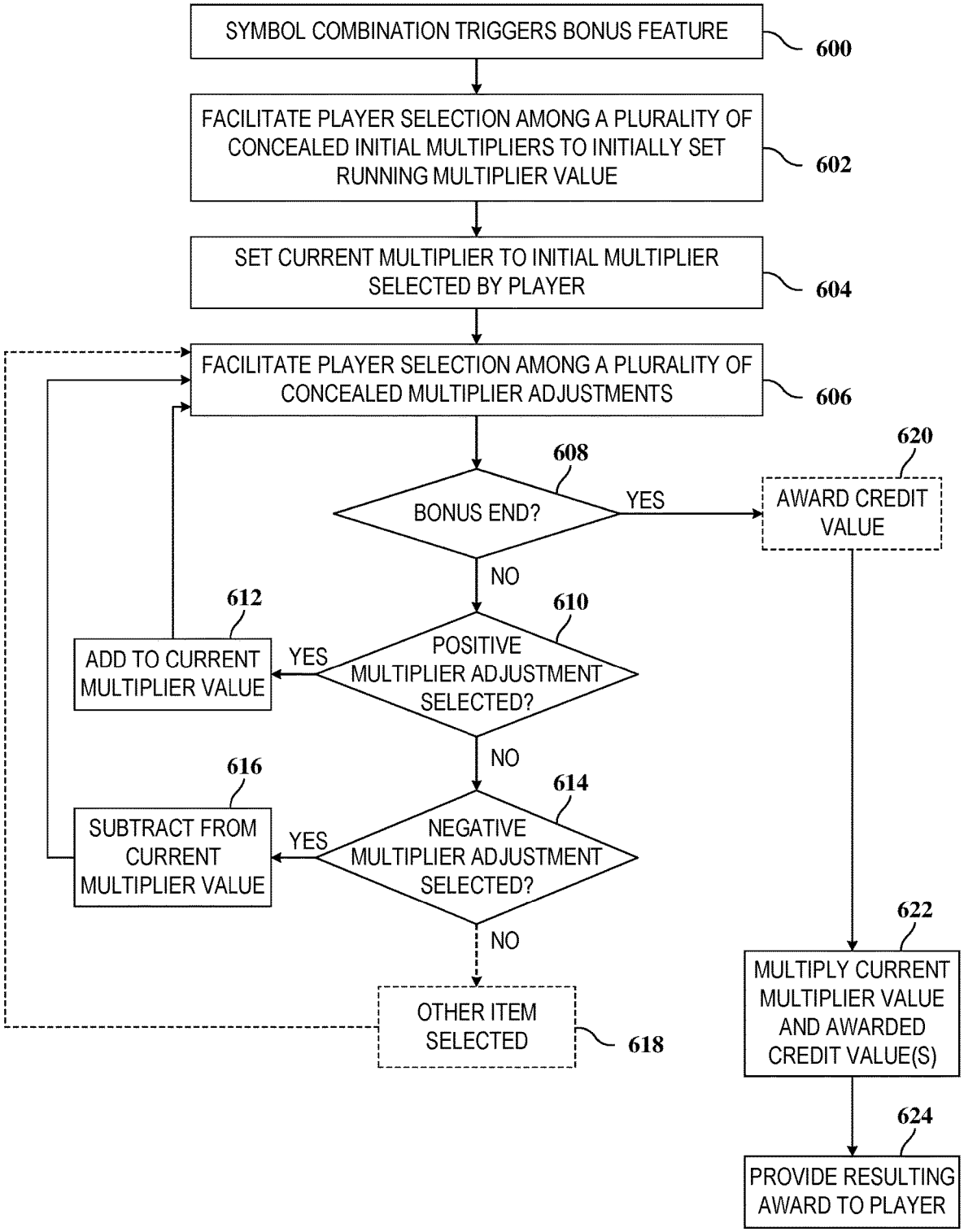
FIG. 6 is a flow diagram illustrating another representative embodiment of a manner in which a gaming machine or other computing environment can enhance gaming awards through potential upwards or downwards modifier adjustments.

FIG. 6 is a flow diagram illustrating another representative embodiment of a manner in which a gaming machine or other computing environment can enhance gaming awards through potential upwards or downwards modifier adjustments. In this particular embodiment, a symbol combination triggers 600 a bonus feature. Upon initiation of the bonus feature, the gaming system facilitates 602 player selection among a plurality of concealed initial multipliers to initially set a running multiplier value. The current multiplier is set 604 to the initial multiplier that was selected by the player. The gaming system facilitates 606 player selection among a plurality of concealed multiplier adjustments. For example, the player may select a +3× multiplier adjustment that will adjust the current multiplier, thus keeping a running multiplier value as the current multiplier.

If the bonus has not ended 608 (e.g., no modifier termination adjustment event occurred), then if it is determined 610 that a positive multiplier adjustment was selected, that multiplier adjustment is added 612 to the current multiplier value, and selection of another multiplier adjustment is facilitated 606 (e.g., presenting a plurality of items selectable via a user interface). Otherwise, if it is determined 614 that a negative multiplier adjustment was selected, that multiplier adjustment is subtracted 616 from the current multiplier value, and selection of another multiplier adjustment is facilitated 606. In some embodiments, still other items may be selected 618, such as a null value, a non-terminating credit value, a non-credit prize, etc.

The updating of the current multiplier value may continue until the bonus ends 608. The bonus may and based on game rules, such as fixed occurrence of the Nth player selection of an item or of a multiplier adjustment, a random termination time/event, the Nth selection of a credit value or other item that is not a multiplier adjustment, the sum of N selected credit values, the credit value (or sum of credit values) exceeding a threshold, random occurrence of indicia indicating the adjustment period has terminated, etc. In one embodiment, the bonus ends when the player selects a credit value among the plurality of concealed multiplier adjustments facilitated 606 by the gaming system. In such an embodiment, the credit value is awarded 620. Alternatively, the credit value may be awarded 620 in any manner as described herein or otherwise apparent to those skilled in the art from the description provided herein. The current multiplier value (as adjusted through the multiplier adjustment process) and the awarded credit value are multiplied 622 to provide 624 the resulting award to the player.

Figure 7A:
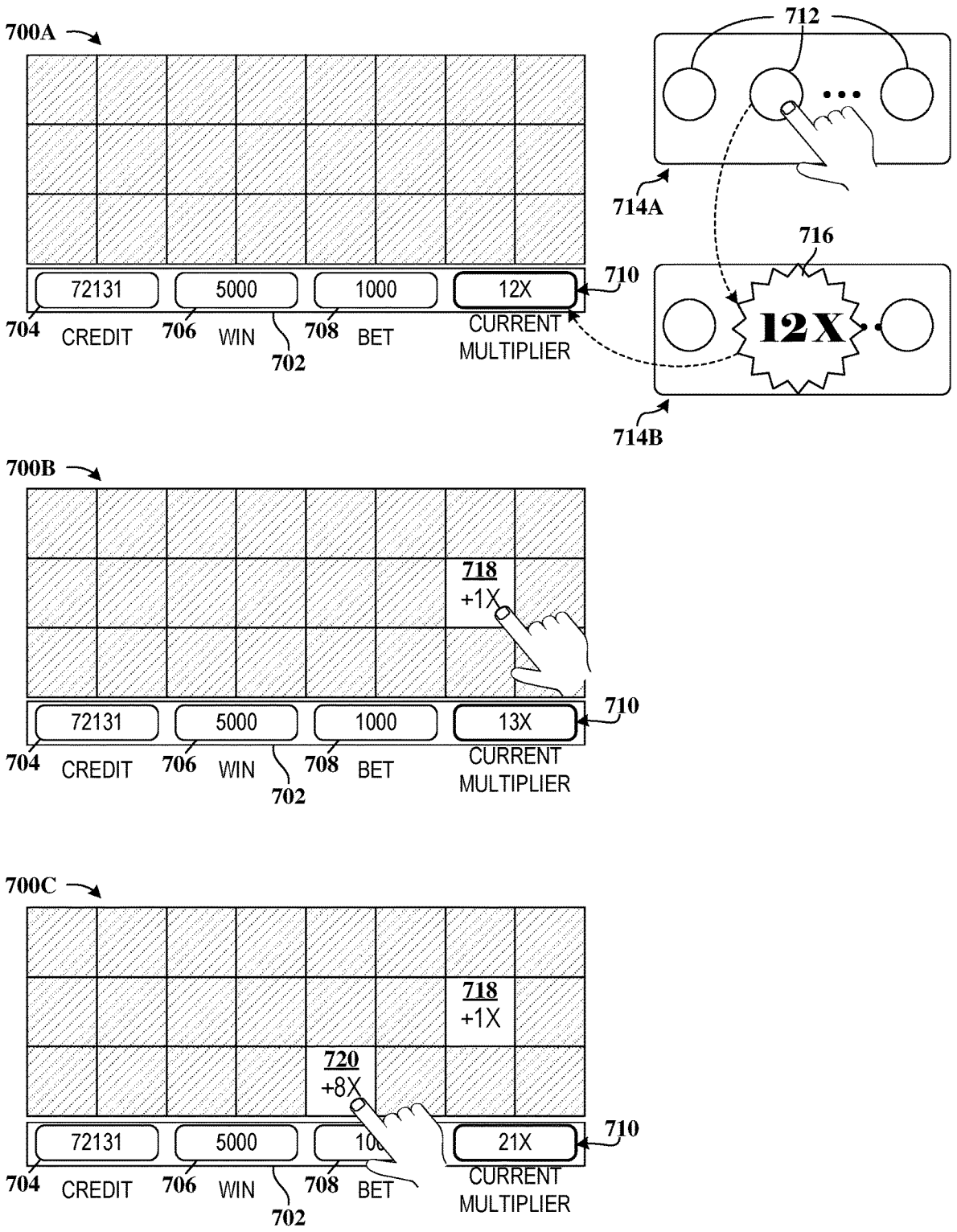
FIGS. 7A and 7B depict a series of gaming presentation events illustrating one representative manner for enhancing payout awards in gaming systems.
Figure 7B:
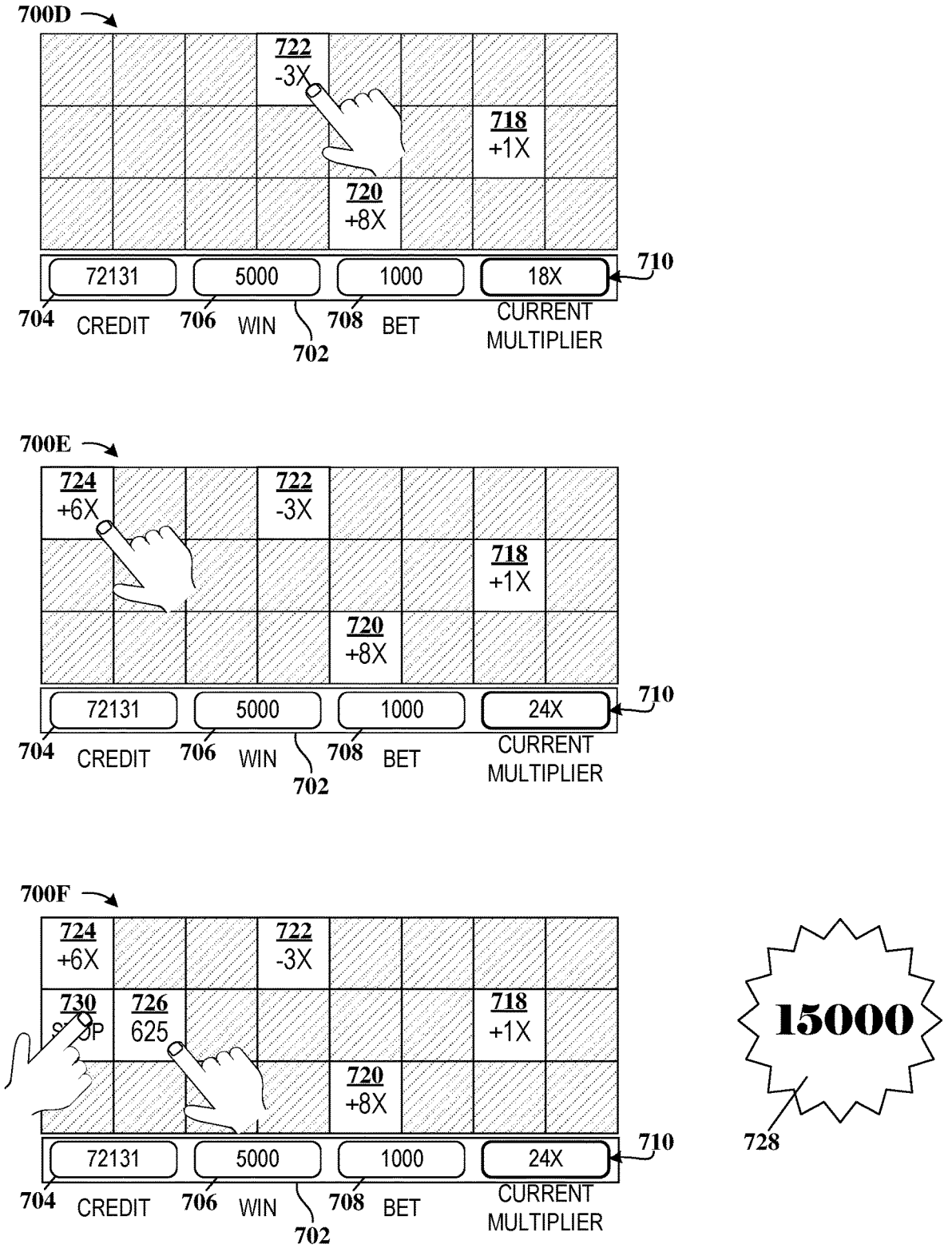

FIGS. 7A and 7B depict a series of gaming presentation events illustrating one representative manner for enhancing payout awards in gaming systems. This embodiment assumes a primary game instigated a bonus event, although the following applies equally to a game in and of itself. In this example, a grid 700A of symbol locations or other display elements are presented, such as via a gaming machine display. The representative gaming machine includes a user interface 702, which may include items such as a credit total 704, current win amounts 706, the amount bet 708, etc. In accordance with the present disclosure, the current multiplier 710 is also presented. While the present example is described in terms of a multiplier, the description is equally applicable to other award modifiers with other mathematical enhancement capabilities (e.g., exponential via an adjustable exponent, addition, factorial, etc.). However, for purposes of the present example, a multiplier is assumed, and the current multiplier 710 serves as an adjustable value that is ultimately applied to a payout to enhance that payout.

In one embodiment, the player is allowed to select from a plurality of selectable items 712, possibly displayed via a display area 714A, to identify the initial multiplier value. In this example, the player selects one of the selectable items 712, resulting in a 12× multiplier 716 in this example. Therefore, the initial multiplier becomes the current multiplier 710, which is a 12× multiplier in this example.

Grid 700B of FIG. 7A then depicts a representative manner in which the gaming system facilitates user selection of one or more multiplier adjustment values. In this example, the player has selected a concealed symbol location 718, which resulted in a +1× multiplier adjustment value. Therefore, the current multiplier 710 changes to 13× as depicted via grid 700B.

The multiplier adjustment continues until terminated. In the illustrated embodiment, the player again selects a symbol location in grid 700C of FIG. 7A. In this example, the player has selected a concealed symbol location 720, which resulted in a +8× multiplier adjustment value. Therefore, the current multiplier 710 changes to 21× as depicted via grid 700C. The player again selects a concealed symbol location 722 in grid 700D of FIG. 7B, which resulted in a −3× multiplier adjustment value. Therefore, the current multiplier 710 reduces to 18× as depicted via grid 700D. The player again selects a concealed symbol location 724 in grid 700E of FIG. 7B, which resulted in a +6× multiplier adjustment value. Therefore, the current multiplier 710 increases to 24× as depicted via grid 700D.

The player again selects a concealed symbol location 726 in grid 700F of FIG. 7B, which resulted in a credit value of 625 credits. In one embodiment, selection of a credit value establishes the credit value to be modified by the current multiplier 710, but also terminates selection of further multiplier adjustment values. Thus, the 625 credit value is multiplied by the current multiplier 710 of 24×, resulting in a final payout/award of 625×24=15,000 credits shown via presentation area 728. It should be recognized that symbol locations that are associated with a credit value (e.g., symbol location 726) may also have a multiplier adjustment value, such that both the current multiplier 710 is adjusted and a credit value is assigned which terminates selection of further multiplier adjustment values.

In other embodiments, termination of the multiplier adjustment may occur in other ways, such as selecting a termination or STOP symbol as depicted at symbol location 730. In such an embodiment, this terminates selection of further multiplier adjustment values, where the current multiplier 710 is then applied to some other player asset. Such other player asset may be an amount 1706, the amount bet 708, a randomly-provided credit value, or any other available credit value or player asset.

Figure 8:
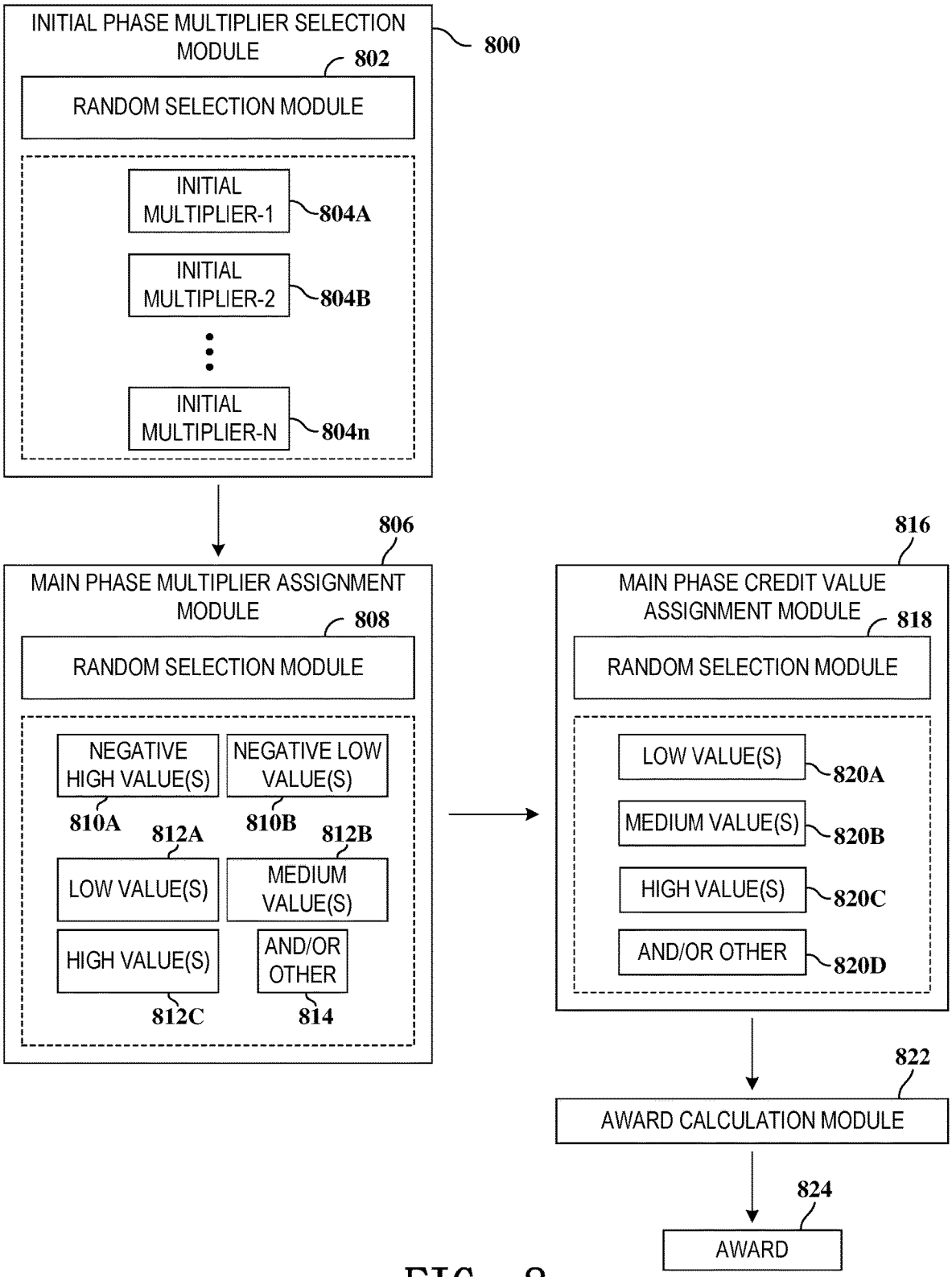
FIG. 8 depicts an embodiment where a processing arrangement is programmed to provide various modules for performing the gaming award adjustment functions described herein.

FIG. 8 depicts an embodiment where a processing arrangement is programmed to provide various modules for performing the gaming award adjustment functions described herein. The representative embodiments described herein may be implemented using processing hardware, storage, software, etc. FIG. 8 depicts an embodiment where a processing arrangement (which may include a single processor, multiple processors, or any other processing arrangement) is programmed with software and/or firmware to provide various modules to perform functions described herein. In the representative example of FIG. 8, the initial phase multiplier selection module 800 may represent the software-programmed or otherwise configured hardware to facilitate player selection of an initial multiplier or other modifier, in embodiments where the player makes a selection(s) for an initial multiplier (versus the system providing the initial multiplier or the initial multiplier being supplied in some other way). The random selection module 802 represents a random number generator (RNG), look-up table, or other programmable manner of assisting with the random selection of an initial multiplier. In the illustrated embodiment, the random selection module 802 randomly associates multiplier values with some number of respective selectable items depicted as initial multiplier-1 804A, initial multiplier-2 804B, through initial multiplier-N 804*n*. The player may then select one of the available selectable items to serve as the initial multiplier for the particular gaming event. Other embodiments may allow the player to select more than one selectable item, where the sum, average, largest, smallest, etc. may be used as the initial multiplier pursuant as defined.

Once an initial multiplier has been established, the main phase multiplier assignment module creates a plurality of selectable multiplier adjustment values that are available for selection by the player. The random selection module 808, which may be an RNG, look-up table, or other programmable manner of assigning multiplier adjustment values to the plurality of selectable items. In the illustrated embodiment, the random selection module 808 randomly assigns at least both negative and positive multiplier adjustment values to the selectable items. In one embodiment, negative high values 810A and negative low values (810B) are among the assignment possibilities, where what is a "high" value and a "low" value may be defined (e.g., high values may be between −5× and −10×, where low values may be between −1× and −2×). In other embodiments, the possible negative multiplier adjustment values may be confined to a continuous range of negative values (e.g., −1× to −10×).

In one embodiment, positive low values 812A, positive medium values 812B, and/or positive high values may be among the assignment possibilities, where what is a "low" value, a "medium" value, and a "high" value may be defined. For example, low values may be between +1× and +2×, medium values may be between +4× and +6×, and high values may be between +8× and +10×. Or, as another example, the low, medium and high values may span a continuum within a range, but by separating between low, medium, and high values, the random selection module 808 may provide a greater weight or possibility for one or more of the particular values 812Z, 812B, 812C. For example, low values may be between +1× and +3×, medium values may be between +4× and +7×, and high values may be between +8× and +12×.

It should be recognized that the values may, in some embodiments, be separated into low or high values, low/medium/high values, X number of divisions (e.g., very low, low, medium, medium-high, high, very high, etc.), random divisions, purely random values, or however the weighting of values is desired. In some embodiments, any use of divisions (e.g., low, medium, high) may be allowed to overlap, such as where low is 1×-4×, medium is 3×-7×, high is 6×-10× (or other maximum value), or the like. In other embodiments, there may be no overlap (e.g., 1×-3×; 4×-6×; 7×-10×), or even gaps between one or more of the ranges (1×-3×; 5×-7×; 10×-15×). Thus, it should be recognized that while various value "ranges" may be used as described in representative examples above, any such ranges may be used, or no ranges may be used, etc. Any manner of obtaining values in a desired range(s) with a statistical occurrence rate may be specifically set, may be purely random, or anything in between.

In still other embodiments, the random selection module 808 may provide other options 814, such as a null/zero selection for a multiplier adjustment value that does not increase or decrease the running, current multiplier value. In yet other embodiments, selections may include other mathematical functions, such as multiplication values to multiply a selected multiplier adjustment value by the current multiplier value (e.g., selection of a ×4×, or "times 4×" multiplier would adjust a current multiplier value of 5× to be 20×, i.e. 4××5×=20×). The other items 814, if used, may include any mathematical function and value to be applied to the current multiplier value.

Therefore, using the main phase multiplier assignment module 806, the player is presented with a plurality of selectable items which include a desired range of at least positive and negative multiplier adjustment values which can upwardly or downwardly adjust the current multiplier value that will ultimately be applied to at least one payout of the gaming event.

The main phase credit value assignment module 816 represents the programmable hardware module that enables identification of a credit value(s) or other player asset(s) in which the current/running multiplier value may be applied. The random selection module 818 represents an RNG, look-up table, and/or other processing module capable of assigning one or more credit values to selectable items, for purposes of the present embodiment. The available credit values may be any value within a particular range of values, or may be tiered into categories such as low values 820A, medium values 820B, high values 820C, and/or other 820D. By separating into low, medium, high (or other) categories, different weighting to such categories may be employed, such as to more heavily weight a medium value 820B selection over the others 820A, 820C, 820D. In one embodiment, when the player has selected any credit value among the selectable items, the modifier adjustment feature ends, and the state of the current modifier value is applied to the selected credit value by the award calculation module 822 to provide the final award 824.

The current multiplier value could be applied to credit values on multiple occasions during participation in the gaming event. For example, in one embodiment, multiple credit values may be allowed to be selected, and each time one is selected, the respective current multiplier value is applied thereto. The enhanced values may be added together for a total payout, and this may occur until some termination event occurs. For example, assume that a random number of credit values may be selected before the payout enhancement feature is terminated. Assume for purposes of this example that that random number of credit values is randomly determined to be two. Thus, assume the player has been selecting multiplier adjustment values via the main phase multiplier assignment module 806, causing the current multiplier value to be 6× (for example), and then selects a 50 credit value. A first enhanced payout would then be 6×50=300 credits. However, because this embodiment does not terminate the award enhancement feature upon receipt of the first credit value (but rather upon receipt of the N-th credit value, where N is a randomly determined number, or a fixed number in other embodiments), the player is allowed to continue to select selectable items. Assume that further selections presented via the main phase multiplier assignment module 806 cause the current multiplier value to adjust to 9×, and a second credit value of 25 credits is then selected. Therefore, the second enhanced payout would then be 9×25=225 credits. Since selection of two credit values was, in this example, deemed a terminating event, further enhancements to payouts is terminated, and the final result 824 can be calculated as the sum of the two enhanced credit values, 300+225=525 credits.

Thus, some embodiments such as that of FIG. 8 and others described herein may be divided into multiple phases from the player's perspective, such as at least two phases including the initial phase and the main phase. In such an embodiment, the initial multiplier value is revealed to the player and becomes the player's total multiplier. Play then continues to the main phase, where the player selects from a plurality of symbol locations or "tiles," (e.g., 24 tiles), some of which (e.g., perhaps 4 of the 24) contain hidden credit values while the remaining (e.g., 20 of the 24) contain hidden multiplier values. If the player selects a multiplier value, the value is added to the player's total multiplier and the player is awarded an additional pick. The selected value may be negative, in which case the total multiplier will decrease. If the player selects a credit value, that value is multiplied by the total multiplier and the resulting amount is awarded to the player. The bonus then ends in such an embodiment.

In one embodiment, a computer-implemented manner for determining the multiplier or credit values associated with the tiles involves selecting values for the main phase and for the initial phase. For example, selecting values for the main phase may involve including a number of types of main phase multipliers and a number of types of credit values, such as was described in connection with FIG. 8. As a more particular example corresponding to the embodiment of FIG. 8, the main phase multipliers may be grouped into five types of main phase multipliers (negative high values 810A, negative low values 810B, low values 812A, medium values 812B, in high values 812C. In such embodiment, the credit values are grouped into low values 820A, medium values 820B, and high values 820C. In one embodiment, using a table, the number of tiles of each type to choose can be determined. Such table may vary between games, and may also vary with other desired characteristics (e.g., bet level of the initiating game, etc.). The system then selects the appropriate number of tiles for each type using the appropriate table. In an illustrative embodiment, all draws are made by weighted random selection with replacement; all credit values may be multiplied by the bet multiplier of the initiating game; and all values and weights vary between titles and with the bet level of the initiating game.

For the initial phase where an initial multiplier (or other modifier) is selected, one embodiment involves the system first selecting the values for a plurality (e.g., three) selectable items from which the player may choose. One manner for selecting such values for the plurality of tiles (three tiles in the forthcoming example) is to first determine the total sum of all negative multipliers determined in the computer-implemented manner for determining the multiplier, choose three (in this example) values from a table by random draw without replacement, and add the absolute value of the total negative sum to each of such three values chosen from the table by random draw. This will provide three (in this example) initial multiplier values with no repetition, and may then serve as the initial multiplier values to be associated with the selectable items presented to the player for selection in the initial phase. In one embodiment, the (three in this example) values selected from the table by random draw are positive values, so this step guarantees that the multiplier counter will always remain positive, in this embodiment.

There are a wide variety of variations that may be employed. For example, one or more individual parameters could be changed. In particular, this may include the number of initial multiplier choices for the player, the number of credit selection groups, the number of multiplier selection groups, the number of negative multiplier selection groups, etc. In another embodiment, the initial phase could be omitted, with the player given an initial multiplier value, which could be determined in the manner analogous to that described above (i.e. first determine the total sum of all negative multipliers determined in the computer-implemented manner for determining the multiplier, choose some number (e.g., three) values from a table by random draw without replacement, and add the absolute value of the total negative sum to each of such three values chosen from the table by random draw). In another embodiment, before the award is made, any multiplier counter below some minimum threshold value is set equal to the minimum threshold.

In another embodiment, a final phase could be added after the main phase, but before the award. This final phase could present the player with a selection of one or more multiplier values. The chosen value would increase the multiplier counter by that value.

In another embodiment, the selection of the initial multiplier could be altered in a way which would allow the multiplier counter to potentially become zero or negative. At the conclusion of the bonus, before the award is made, the multiplier counter could be adjusted to meet some minimum threshold, or using a final phase as noted above, or otherwise.

In one embodiment, during participation in the gaming feature, a value is set as a minimum threshold. Any choice that would otherwise cause the multiplier counter to drop below the threshold could instead cause the multiplier counter to take the threshold value. This could be done with or without adjustment to the initial phase.

In another embodiment, the player may be allowed a number of "strikes," where the player chooses until some fixed number of credit selections have been made. The sum of the credit values is multiplied by the multiplier counter to obtain the award amount. In other embodiments, only the largest credit value may be used for the award, where in other embodiments the last credit value chosen may be used for the award, or the like.

Figure 9:
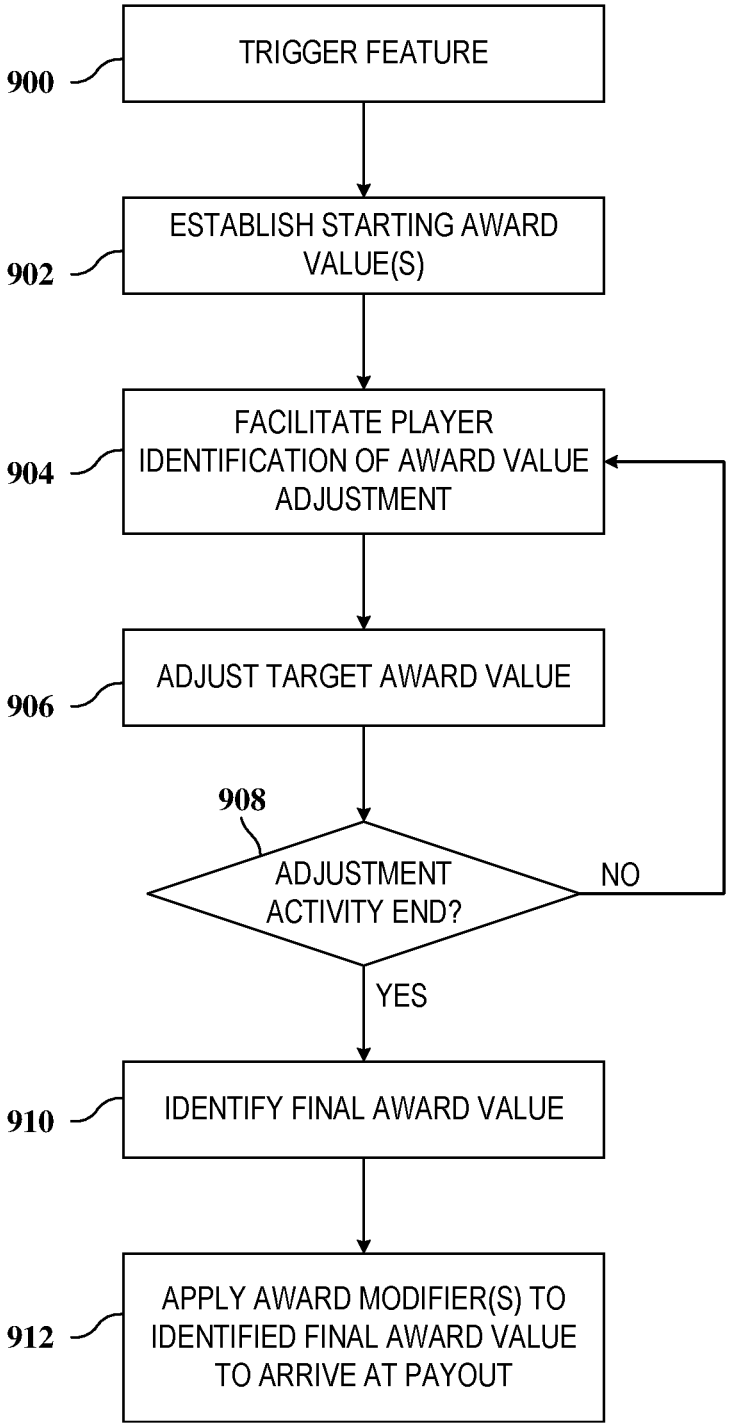
FIG. 9 is a flow diagram illustrating an embodiment for adjusting gaming payouts by adjusting the target credit value or other player assets and applying a multiplier to the running credit total.

FIG. 9 is a flow diagram illustrating an embodiment for adjusting gaming payouts by adjusting the target credit value or other player assets and applying a multiplier to the running credit total. Thus, the credit values may be adjusted rather than the multiplier values. In this embodiment, the feature is triggered 900, and the starting award value(s) is established 902, such as by allowing the player to select from a plurality of selectable items containing hidden starting award values. The system facilitates 904 player identification of award value adjustments, such as increases or decreases to a running credit award. The current/running award value is adjusted 906, such as through the player's selections from a plurality of selectable items with hidden award value adjustments that are added to or subtracted from the current award value. Until the adjustment activity ends 908, the system continues to facilitate 904 player identification of award value adjustments, and the target award value is accordingly adjusted 906. When the adjustment activity ends 908, the final award value is identified 910 and a final payout can be calculated by applying 912 any award modifiers (e.g., awarded multiplier) to the identified final award value. The award modifier(s) can be randomly supplied, provided with a primary game, or identified in any desired fashion to be applied to the identified final award value 910 to arrive at the payout 912. In this manner, a running credit value is maintained as award value adjustments increase or decrease (or in some instances neither increase nor decrease) the running credit value, whereby the adjustment activity ends in connection with some predetermined event. In one embodiment, selection of an award modifier that can be applied to the final award value terminates the adjustment activity.

Figure 10:
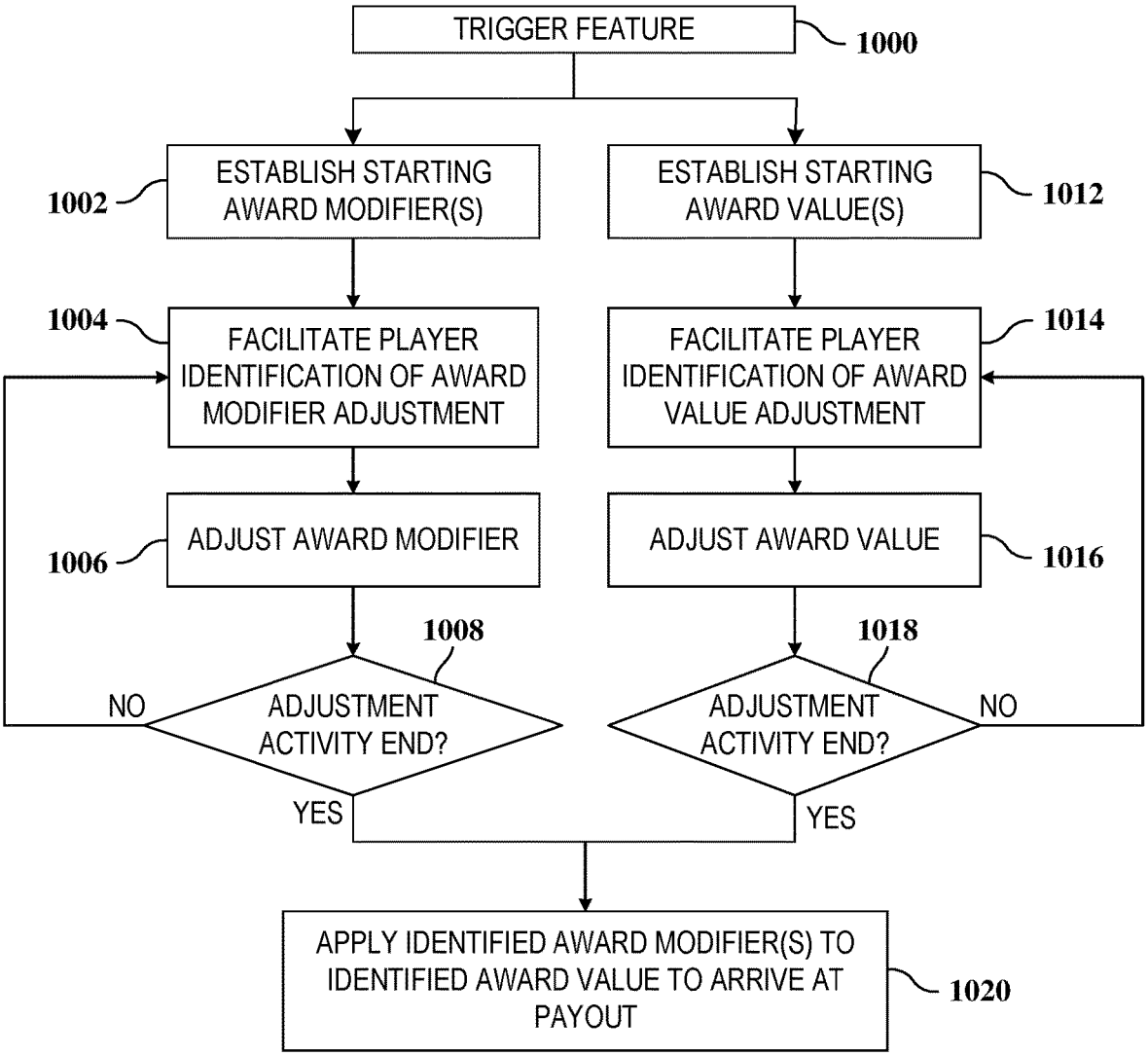
FIG. 10 is a flow diagram illustrating an embodiment for adjusting gaming payouts by adjusting both the target credit value (or other player assets) and the award modifier.

FIG. 10 is a flow diagram illustrating an embodiment for adjusting gaming payouts by adjusting both the target credit value (or other player assets) and the award modifier. The feature may be triggered 1000 in any fashion. A starting award modifier is established 1002, and a starting award value is established 1012. The starting award modifier and starting award values may be established 1002, 1012 as described herein, such as by facilitating selection among a plurality of selectable items. The system facilitates 1004 player identification of award modifier adjustments, such as multiplier increments or decrements, and upon player identification of such, the current award modifier is adjusted by a commensurate amount. Until the adjustment activity ends 1008, the system continues to facilitate 1004 player identification of award modifier adjustments and consequent adjustment 1006 of the running/current award modifier.

In parallel, in succession, or alternatingly, the system facilitates 1014 player identification of an award value adjustment. For example, the player may select an award adjustment (e.g., add 40 credits) among a plurality of selectable items, whether selectable among a common pool with the award modifier adjustments or separately. The system facilitates 1014 player identification of award value adjustments, and upon player identification of such, the current award value is adjusted 1016 by a commensurate amount. Until the adjustment activity ends 1018, the system continues to facilitate 1014 player identification of award value adjustments and consequent adjustment 1016 of the running/current award value.

When the adjustment activity has ended 1008, 1018 for both of the award modifier adjustments and award value adjustments, the identified award modifier is applied 1020 to the identified award value to arrive at the payout. In this manner, both the awarded credit amount and the awarded modifier can be adjusted during participation in the gaming feature to create excitement and anticipation for the final payout that results from applying (e.g., multiplying) the current modifier to the current award value when continued selection of adjustments thereto has been terminated.

Figure 11A:
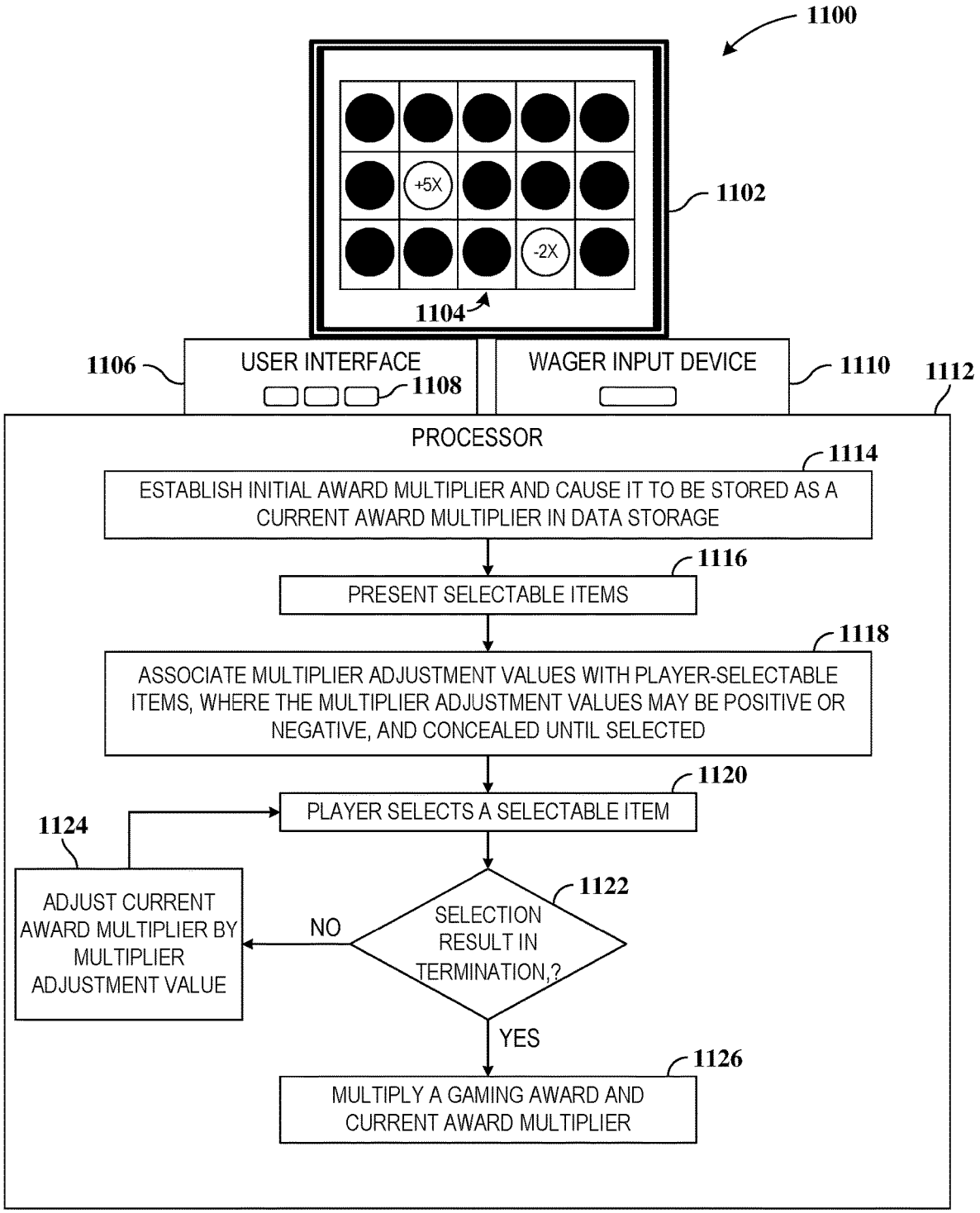
FIGS. 11A and 11B are block diagrams of representative alternative slot game apparatuses having software-programmed or otherwise designed/configured hardware for enhancing gaming payouts in accordance with the disclosure.
Figure 11B:
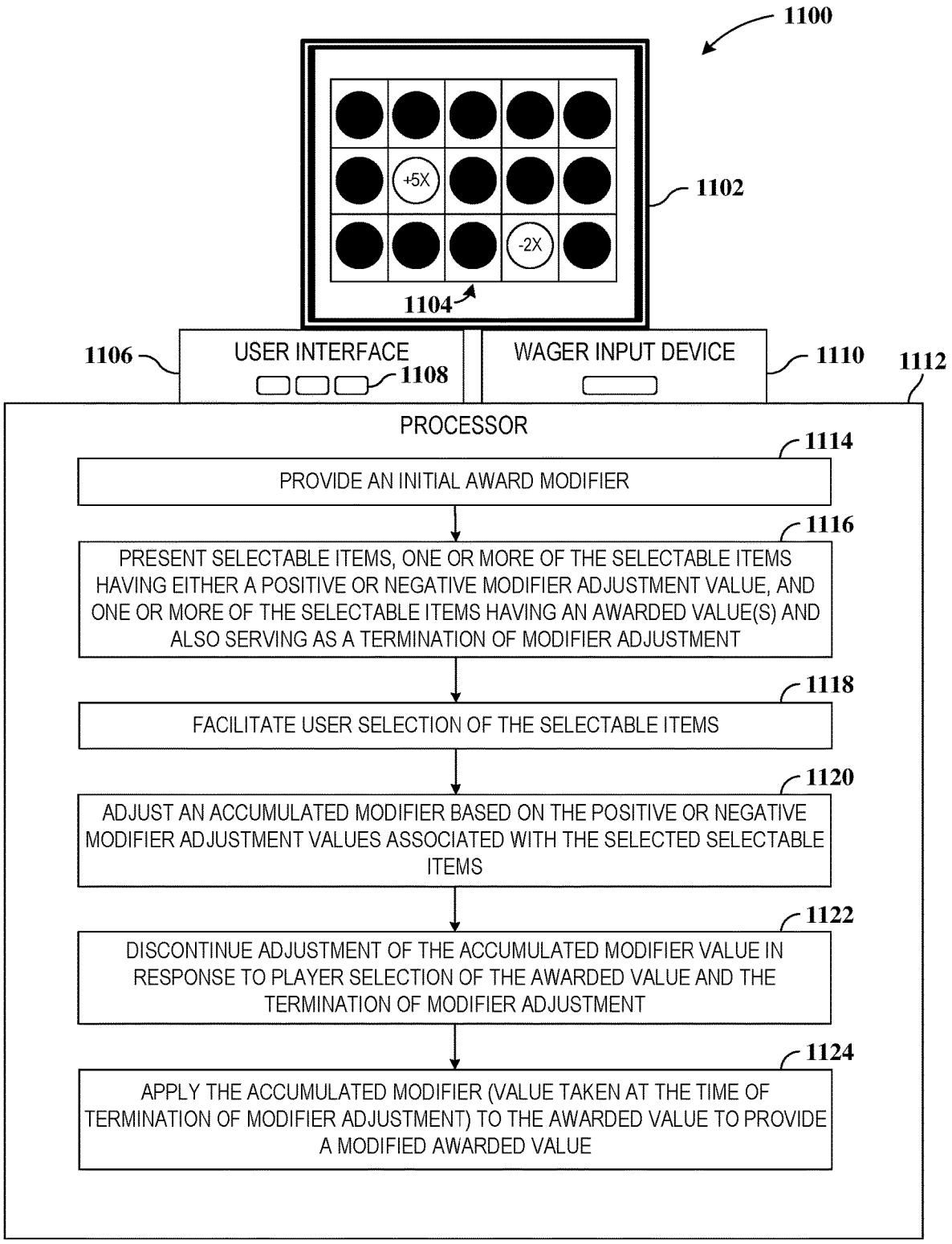

The functionality provided herein may be implemented in hardware on computing devices ranging from large gaming systems, stand-alone kiosks, to small personal devices. FIGS. 11A and 11B depict representative, illustrative slot game embodiments where a processing arrangement (which is intended to include single processors, multiple processors, or any other processing arrangement) is programmed with software and/or firmware to provide various modules to perform functions described herein. The principles in FIGS. 11A and 11B are equally applicable to games other than slot games, such as poker or other card games, bingo, roulette, craps, or other games where a result could be replayed in a video/electronic context or properly configured physical implementations. In the representative examples of FIGS. 11A and 11B, each of the modules represents software-programmed or otherwise designed/configured hardware to carry out functions to facilitate the gaming features described herein.

FIGS. 11A and 11B are block diagrams of representative alternative slot game apparatuses for enhancing gaming payouts in accordance with the disclosure. In the embodiment of FIG. 11A, a slot game device 1100 is provided on which players can play slot games. The representative slot game device 1100 includes at least a display 1102 presenting a slot game symbol array or "grid" 1104 of symbol locations or display elements, a user interface 1106 including at least one user input 1108 to enable a player to initiate a slot game event presented via the slot game grid 1104 and/or select items, and a wager input device 1110 structured to identify and validate player assets and ultimately permit the player to play the slot game event when the player assets are provided.

The slot game device 1100 includes a processor 1112 configured to establish 1114 an initial award multiplier and cause it to be stored as a current award multiplier in data storage. The processor 1112 can cause the display 1102 to present 1116 selectable items that will serve as hosts for concealed, selectable award multipliers. The processor 1112 is programmed to associate 1118 multiplier adjustment values to respective ones of the player-selectable items. In one embodiment, at least one of the multiplier adjustment values is a positive value and at least one of the multiplier adjustment values is a negative value. In one embodiment, the positive adjustment values exceed the negative adjustment values to increase the chances of the player obtaining a final multiplier that is a positive number. In other embodiments, a positive final multiplier is guaranteed within the system (where this "guarantee" may or may not be known to the player), so that a negative final multiplier will never occur, although negative multiplier adjustment values can occur to reduce the running total of the current multiplier.

The player is allowed to select 1120 a selectable item(s). In the illustrated embodiment, if the selection does not result in termination of the multiplier adjustment feature, then a multiplier adjustment value was selected 1120, and the current award multiplier is adjusted 1124 by the multiplier adjustment value. As seen in the example of FIG. 11A, this player selection 1120 and current award multiplier adjustment 1124 can continue until the player's selection 1120 results in termination the feature as determined at block 1122. When the player's selection 1120 results in termination as determined at block 1122, a gaming award is multiplied 1126 by the current award multiplier to provide an enhanced gaming payout.

The slot game device 1100 configures the processor 1112 (which may include one or more cooperative processing devices) to structurally program functional elements into hardware modules. Processor 1112 circuitry configuration thus changes based on the modules developed by software to carry out the desired methodology. For example, the processor 1112 is programmed by software/code to create a hardware-based module to establish 1114 the initial award multiplier and to create other such software/code modules for each of the operations 1114-1126.

Other structural modules may be created on the slot game device using a properly configured processor 1112. Referring now to the example of FIG. 11B, an apparatus is provided for modifying gaming awards in gaming activities. The processor 1112 may be configured into programmed modules to provide 1114 an initial award modifier, which may be provided directly to the player, randomly selected by the player, etc. The processor 1112 may be configured into programmed modules to present 1116 multiple selectable items, one or more of the selectable items having either a positive or negative modifier adjustment value associated therewith, and one or more of the selectable items having at least an awarded value that serves as a termination of modifier adjustment in addition to a grant of the awarded value. The processor may be programmed to further facilitate 1118 user selection of the selectable items, adjust 1120 an accumulated modifier based on the positive or negative modifier adjustment values associated with the selected ones of the selectable items, and discontinue 1122 adjustment of the accumulated modifier value in response to player selection of the awarded value and the termination of modifier adjustment. The programmed processor further applies 1124 the accumulated modifier at the time of termination of modifier adjustment to the awarded value to provide a modified awarded value.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game device for providing a gaming award with one or more variable factors being favorably or unfavorably adjustable during player participation that results in the gaming award, the slot game device comprising:

a display presenting a plurality of symbol locations forming an array;

a user interface including at least one user input to enable a player to select the symbol locations presented via the array;

a wager input device structured to identify and validate player assets, and to permit the player to play the slot game event when the player assets are provided;

a processor;

a processor-executable modifier assignment program module configuring the processor to assign both positive and negative award modifier adjustment values to concealed player-selectable items presented via the display, to facilitate repeated player selection via the user interface of different ones of the concealed player-selectable items to reveal their respective award modifier adjustment values, and to maintain a running total of a current award modifier as prescribed by the player-selected award modifier adjustment values;

a processor-executable credit value assignment program module configuring the processor to assign at least one credit value to the concealed player-selectable items presented via the display, to facilitate player selection via the user interface of at least one of the concealed player-selectable items to reveal its selected credit value, and to terminate further player selection of the concealed player-selectable items in response to player selection of the at least one of the concealed player-selectable items revealing the selected credit value; and a processor-executable gaming award calculation program module configuring the processor to calculate the gaming award based on the selected credit value as modified by the running total of the current award modifier at the time of the player selection of the selected credit value.

2. The slot game device as in claim 1, further comprising a processor-executable initial modifier assignment program module configuring the processor to facilitate identification of an initial modifier to initially set the current award modifier.

3. The slot game device as in claim 2, wherein the processor-executable initial modifier assignment program module configures the processor to facilitate identification of an initial modifier by presenting a plurality of concealed initial modifiers, and facilitating player selection of at least one of the concealed initial modifiers to reveal the respective initial modifier and to set the current award modifier to the respective initial modifier.

4. The slot game device as in claim 1, wherein the processor-executable modifier assignment program module further configures the processor to assign a zero award modifier adjustment value to the concealed player-selectable items, and to cause the current award modifier to remain unchanged in response to the player selecting the zero award modifier adjustment value from the concealed player-selectable items.

5. The slot game device as in claim 1, wherein:

the positive and negative award modifier adjustment values respectively comprise positive and negative award multiplier adjustment values, and the running total of a current award modifier comprises a running total of a current award multiplier; and the processor-executable gaming award calculation program module configures the processor to calculate the gaming award based on the selected credit value multiplied by the running total of the current award multiplier at the time of the player selection of the selected credit value.

6. The slot game device as in claim 1, wherein the processor is configured to initiate a bonus event in response to a trigger feature, and in response thereto, to enable the slot game device to provide the gaming award with one or more variable factors being favorably or unfavorably adjustable during player participation that results in the gaming award.

7. The slot game device as in claim 1, wherein the processor-executable modifier assignment program module configures the processor to maintain a running total of a current award modifier by adding positive ones of the modifier adjustment values to the running total of the current award modifier, and subtracting negative ones of the modifier adjustment values from the running total of the current award modifier.

8. The slot game device as in claim 1, wherein:

the processor-executable credit value assignment program module configures the processor to assign a plurality of credit values to respective ones of the concealed player-selectable items presented via the display, to facilitate player selection via the user interface of a plurality of the concealed player-selectable items to reveal their respective selected credit values, and to terminate further player selection of the concealed player-selectable items in response to player selection of a number of the concealed player-selectable items revealing respective selected credit values; and a processor-executable gaming award calculation program module configures the processor to calculate the gaming award based on a total of the selected credit values as modified by the running total of the current award modifier at the time of the player selection of a final one of the selected credit values.

9. A slot game device for enhancing gaming awards in slot games, comprising:

a display presenting a plurality of grid locations forming an array;

a user interface including at least one user input to enable a player to select the grid locations presented via the array;

a wager input device structured to identify and validate player assets, and to permit the player to play the slot game event when the player assets are provided; and a processor configured to:

provide an initial award multiplier;

provide a plurality of selectable items, one or more of the selectable items having either a positive or negative multiplier adjustment value associated therewith, and one or more of the selectable items having at least a credit award that serves as a termination of multiplier adjustment in addition to a grant of the credit award;

cause the display to present the selectable items, and to recognize the selectable items selected via the user interface;

facilitate player selection of the selectable items, and to cause the display to reveal the positive or negative multiplier adjustment value or the credit award when selected by the player;

adjust an accumulated multiplier based on the positive or negative multiplier adjustment values associated with the selected ones of the selectable items, and cause the display to present the accumulated multiplier as it is adjusted;

discontinue adjustment of the accumulated multiplier value in response to player selection of the credit award and the termination of multiplier adjustment; and multiply the accumulated multiplier at the time of termination of multiplier adjustment to the credit award to provide an enhanced gaming award.

10. The slot game device as in claim 9, wherein the processor is configured to provide the initial award multiplier by causing the display to present a plurality of selectable initial items concealing initial award multipliers to the player, and to set the accumulated multiplier to the initial award multiplier associated with the selectable initial item selected by the player.

11. The slot game device as in claim 9, wherein the processor is configured to adjust the accumulated multiplier by adding the selected positive multiplier adjustment values to the accumulated multiplier value, and by subtracting the selected negative multiplier adjustment values from the accumulated multiplier value.

12. The slot game device as in claim 9, wherein the processor is configured to cause the display to present each of the plurality of selectable items in respective ones of the grid locations of the array.

13. The slot game device as in claim 9, wherein the processor is configured to recognize triggering of a bonus event, and in response thereto, to enable the slot game device to suspend activity in a primary gaming event and provide the enhanced gaming award via the bonus event.

14. The slot game device as in claim 9, wherein the processor is configured to adjust the accumulated multiplier by increasing or decreasing the accumulated multiplier based on the positive or negative multiplier adjustment values selected via the selectable items.

15. A method for enhancing gaming awards in gaming activities, comprising:

establishing an initial award multiplier and presenting the initial award multiplier via a display, and causing the initial award multiplier to be stored as a current award multiplier in data storage;

presenting a plurality of player-selectable items via the display;

associating multiplier adjustment values to respective ones of the player-selectable items, wherein at least one of the multiplier adjustment values is a positive value and at least one of the multiplier adjustment values is a negative value;

concealing the multiplier adjustment value until its respective one of the player-selectable items is selected;

monitoring a user interface to determine which of the player-selectable items is selected;

adjusting the current award multiplier by each selected one of the multiplier adjustment values, and presenting via the display the current award multiplier each time it is adjusted;

allowing further selections of the player-selectable items via the user interface until a termination event occurs;

disallowing further selections of the player-selectable items when the termination event occurs; and multiplying a gaming award and the current multiplier value at the time the termination event occurs to create an enhanced gaming award.

16. The method of claim 15, further comprising associating one or more credit values to respective ones of the player-selectable items, and establishing the gaming award as a selected one of the player-selectable items having the credit value.

17. The method of claim 16, further comprising establishing the player selection of one of the player-selectable items having the credit value as the termination event.

18. The method of claim 16, wherein the player-selectable item having the credit value also includes one of the multiplier adjustment values.

19. The method of claim 15, further comprising displaying a plurality of second player-selectable items each having a respective concealed initial award modifier associated therewith, and wherein establishing an initial award multiplier comprises assigning a player-selected one of the initial award multipliers as the initial award multiplier.

20. The method of claim 15, wherein the gaming activity comprises a bonus event triggered by activity in a primary gaming event.

* * * * *